US010526742B2

(12) United States Patent
Kim et al.

(10) Patent No.: US 10,526,742 B2
(45) Date of Patent: Jan. 7, 2020

(54) WASHING MACHINE

(71) Applicant: Samsung Electronics Co., Ltd, Gyeonggi-do (KR)

(72) Inventors: Seung Oh Kim, Gyeonggi-do (KR); Young Myung Son, Gyeonggi-do (KR); Marenne Pierre, Seoul (KR); Ji Hoon Choi, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 140 days.

(21) Appl. No.: 15/186,348

(22) Filed: Jun. 17, 2016

(65) Prior Publication Data

US 2016/0369444 A1 Dec. 22, 2016

(30) Foreign Application Priority Data

Jun. 19, 2015 (KR) ..... 10-2015-0087118
Nov. 23, 2015 (KR) ..... 10-2015-0164275

(51) Int. Cl.
*D06F 37/24* (2006.01)
*D06F 37/26* (2006.01)
*D06F 37/20* (2006.01)

(52) U.S. Cl.
CPC ..... *D06F 37/24* (2013.01); *D06F 37/20* (2013.01); *D06F 37/268* (2013.01)

(58) Field of Classification Search
CPC ..... D06F 37/20; D06F 37/24; D06F 37/268
See application file for complete search history.

(56) References Cited

U.S. PATENT DOCUMENTS 3,021,956 A * 2/1962 Bochan ..... D06F 37/24 210/364
3,373,961 A * 3/1968 Long ..... D06F 37/20 210/364
4,625,529 A * 12/1986 Anderson ..... D06F 37/24 248/612
6,286,344 B1 * 9/2001 Jeon ..... D06F 23/06 68/173
2011/0167878 A1 * 7/2011 De Angelo Sanchez ..... D06F 37/24 68/212
2012/0056517 A1 * 3/2012 Noh ..... D06F 37/24 312/228
2014/0060120 A1 * 3/2014 Yu ..... D06F 37/24 68/132

(Continued)

FOREIGN PATENT DOCUMENTS

KR 20-1990-0012267 7/1990
KR 19900017100 U 10/1990

(Continued)

OTHER PUBLICATIONS

Machine translation of Kr 1998011453U. (Year: 1998).*
Machine translation of KR-100437781-B1 to Park. (Year: 2004).*

*Primary Examiner* — Joseph L. Perrin

(57) ABSTRACT

A washing machine includes a plurality of suspension units through which a tub is supported by a cabinet, and a stabilizer unit mounted to the tub. When horizontal vibration displacement of the tub occurs by unbalance mass during washing/dehydration processes, the washing machine limits tub displacement according to the attenuation effect caused by torsional force and bending force of the stabilizer unit, resulting in reduction of excessive vibration.

20 Claims, 26 Drawing Sheets

(56) References Cited

U.S. PATENT DOCUMENTS

| | | | | |
|---|---|---|---|---|
| 2016/0369444 | A1* | 12/2016 | Kim | D06F 37/24 |
| 2017/0183802 | A1* | 6/2017 | Yu | D06F 37/268 |

FOREIGN PATENT DOCUMENTS

| | | | | | |
|---|---|---|---|---|---|
| KR | 2019910003156 | A | * | 5/1991 | D06F 37/20 |
| KR | 1998011453 | U | * | 5/1998 | |
| KR | 100437781 | B1 | * | 6/2004 | |
| KR | 10-2014-0029013 | | | 3/2014 | |
| KR | 10-2015-0081742 | | | 7/2015 | |

* cited by examiner

WASHING MACHINE

CROSS-REFERENCE TO RELATED APPLICATIONS

This application claims the benefit of Korean Patent Application Nos. 10-2015-0087118 and 10-2015-0164275, respectively filed on Jun. 19, 2015 and Nov. 23, 2015 in the Korean Intellectual Property Office, the disclosure of which is incorporated herein by reference.

FIELD

Embodiments of the present disclosure relate to a structure for reducing vibration of a tub of a washing machine, and more particularly to a washing machine including a stabilizer unit configured to reduce vibration of a tub during washing/dehydration operations by a stabilizer bar configured to interconnect a suspension unit and the tub.

BACKGROUND

A washing machine is an apparatus to wash laundry using electricity, and generally includes a tub to store wash water, a spin basket (rotary tub) rotatably installed in the tub, a pulsator rotatably installed on the bottom of the spin basket, and a motor and a clutch assembly to rotate the spin basket and the pulsator. The washing machine further includes an external frame to support weight of the tub and a suspension unit to interconnect the tub and the external frame.

The suspension unit connected to the washing machine is configured to reduce movement of the tub by force through which the tub moves in up, down, left, and right directions according to rotation of the pulsator and the spin basket during washing and dehydration processes. The suspension unit includes a suspension bar connected to a frame forming the external appearance of the washing machine, a spring, and a frictional damper. The suspension bar is suspended from an upper corner of the frame, and is connected to the bottom of the tub so as to support the weight of the tub. The spring for absorbing vibration is configured to attenuate vibration using frictional force based on a displacement.

A conventional suspension device includes a spring and a damper installed in a longitudinal direction of the suspension bar, such that vertical vibration and horizontal vibration can be absorbed according to the installation angles of the spring and the damper. Various kinds of suspension devices are generally used according to various use conditions and various damping schemes, for example, an silence-type suspension device, a case-shaped suspension device, a hybrid-type suspension device, etc.

After a tub is installed in the frame of the conventional suspension device, the conventional suspension device supports the weight and vibration of the tub during washing/dehydrating processes. The conventional suspension device generally absorbs and attenuates only vertical vibration by the spring and the frictional damper installed in the longitudinal direction. Attenuation weight corresponding to a horizontal vector component calculated by the installation angle of the suspension device is applied to horizontal vibration, such that vibration attenuation relatively lower than in the horizontal direction is carried out. In other words, if the suspension attachment angle is large, vertical attenuation force decreases whereas the attenuation weight increases. In contrast, if the suspension attachment angle is small, horizontal attenuation weight decreases whereas vertical attenuation weight increases.

Therefore, if the user desires to increase capacity by increasing only a tub diameter within the same frame width, the suspension attachment angle must be set to a small angle, such that horizontal attenuation force is reduced and horizontal vibration displacement caused by tub vibration is increased. As a result, the conventional suspension device unavoidably contacts the frame, and has difficulty to overcome such vibration displacement, resulting in reduction of washing ability of laundry.

SUMMARY

Therefore, it is an aspect of the present disclosure to provide a washing machine to which stabilizer (anti-roll bar) technology for reducing horizontal vibration displacement (such as vehicle rolling vibration) in a vehicle equipped with an independent suspension device is applied, and limits tub displacement according to the attenuation effect caused by torsional force and bending force of a stabilizer unit when horizontal vibration displacement of the tub occurs by unbalance mass during washing/dehydration processes, resulting in reduction of excessive vibration.

Additional aspects of the invention will be set forth in part in the description which follows and, in part, will be obvious from the description, or may be learned by practice of the invention.

In accordance with one aspect of the present disclosure, a washing machine includes: a cabinet; a tub disposed in the cabinet; a plurality of suspension units configured to attenuate vibration of the tub, and interconnect the tub and the cabinet such that the tub is supported by the cabinet; and a stabilizer unit configured to interconnect the plurality of suspension units, and mounted to the tub.

The stabilizer unit may include: at least one stabilizer bar, both ends of which are connected to at least two suspension units from among the plurality of suspension units; and a mounting member configured to mount the at least one stabilizer bar to the tub.

The stabilizer unit may include: a connection member to connect the at least one stabilizer bar to the suspension unit, wherein the at least one stabilizer bar is mounted to a lateral surface of the tub by the mounting member.

The at least one stabilizer bar may include a first stabilizer bar mounted to a left side of the tub and a second stabilizer bar mounted to a right side of the tub.

The stabilizer bar may include four stabilizer bars respectively mounted to front, rear, left and right sides of the tub.

The connection member may connect two adjacent stabilizer bars to one suspension bar.

The at least one stabilizer bar may be arranged at the bottom surface of the tub by the mounting member.

The stabilizer bar may include two stabilizer bars arranged in parallel at left and right sides of the bottom surface of the tub.

The stabilizer bar may include two stabilizer bars arranged in parallel at front and rear sides of the bottom surface of the tub.

The stabilizer bar may be arranged at lateral and bottom surfaces of the tub by the mounting member.

In accordance with another aspect of the present disclosure, a washing machine includes: a cabinet; a tub disposed in the cabinet; a plurality of suspension units configured to attenuate vibration of the tub, and interconnect the tub and the cabinet such that the tub is supported by the cabinet; and a stabilizer unit configured to connect the tub to the plurality of suspension units. The stabilizer unit may include: a stabilizer bar configured to enclose some parts of a lateral surface of the tub in a circumferential direction; a mounting member configured to mount the stabilizer bar to the lateral surface of the tub; and a connection member configured to connect the stabilizer bar to the plurality of suspension units.

The mounting member includes a convex part through which the stabilizer bar passes, and a fixing portion fixed to the tub. The stabilizer bar may pass through the convex part of the mounting portion in a manner that the stabilizer bar performs the rotational motion and moves in a circumferential direction along the external surface of the tub. The stabilizer bar may be mounted and fixed to the tub by the fixing portion.

The stabilizer unit may include a bush disposed between the convex part of the mounting member and the at least one stabilizer bar so as to suppress vibration and noise.

Each of the plurality of suspension units may include a suspension, a spring, and a damper. The stabilizer bar may be connected to the suspension bar by the connection member.

Both ends of the stabilizer bar may be bent at a predetermined angle so as to receive bending force. Both ends of the stabilizer bar may be connected to different suspension units by the connection member so as to receive torsional force.

The stabilizer bar may be formed to have a cross-sectional view having a hollow circular shape.

The connection member may include a first accommodation portion to accommodate one end of the stabilizer bar and a second accommodation portion to accommodate the suspension bar.

The stabilizer bar may pass through the first accommodation portion of the connection member in a manner that one end of the stabilizer bar may perform the rotational motion and the longitudinal translational motion.

The second accommodation portion of the connection member may be connected to the suspension bar in such a manner that the connection member may rotate about the suspension bar and may perform the translational motion in the longitudinal direction of the suspension bar.

The second accommodation portion of the connection member may include a cut part through which the second accommodation portion is snap-coupled to the suspension bar.

The stabilizer bar may include a bush to suppress vibration and noise in the first accommodation portion of the connection member.

The stabilizer bar may include a felt to suppress vibration and noise in the first accommodation portion of the connection member.

One end of the stabilizer bar may be accommodated in the first accommodation portion of the connection member so as to prevent the stabilizer bar from escaping from the connection member.

The connection member may be formed of rubber. The first accommodation portion and the second accommodation portion may be formed in the shape of through-holes arranged in parallel to each other.

The stabilizer unit may include a plastic bush disposed in the second accommodation portion of the connection member.

In accordance with another aspect of the present disclosure, a washing machine includes a cabinet; a tub disposed in the cabinet; a plurality of suspension units configured to attenuate vibration of the tub, and interconnect the tub and the cabinet such that the tub is supported by the cabinet; and a stabilizer unit configured to connect the tub to the plurality of suspension units. The stabilizer unit may include a stabilizer bar disposed at the bottom surface of the tub, and a mounting member to mount the stabilizer bar to the bottom surface of the tub. The suspension unit may include a connection portion to connect the at least one stabilizer bar to the plurality of suspension units.

The mounting member may include a convex part through which the stabilizer bar passes, and a fixing portion fixed to the tub. The stabilizer bar may pass through the convex part of the mounting portion in a manner that the stabilizer bar may rotate and move in a longitudinal direction. The stabilizer bar may be mounted to the tub by the fixing portion.

The suspension unit may include the connection portion located at a lower end thereof, and the connection unit may include an accommodation hole through which the stabilizer bar passes.

The accommodation hole may be formed to have a longer longitudinal direction of the suspension unit in a manner that the stabilizer bar may move in the longitudinal direction of the suspension unit.

The suspension unit may include a bush to suppress vibration and noise in the accommodation hole of the connection portion.

In accordance with another aspect of the present disclosure, a washing machine includes: a cabinet; a tub disposed in the cabinet; a plurality of suspension units configured to attenuate vibration of the tub, and interconnect the tub and the cabinet such that the tub is supported by the cabinet; and a stabilizer unit configured to interconnect the plurality of suspension units, and mounted to the tub. The stabilizer unit may include: at least one stabilizer bar, both ends of which are connected to at least two suspension units from among the plurality of suspension units; and a mounting member configured to mount the at least one stabilizer bar to the tub.

The washing machine may further include: a mounting portion mounted to an external surface of the tub such that the mounting member is mounted thereto, wherein the mounting member includes a buffering member accommodated in the mounting portion, and a fixing member which fixes the buffering member to the mounting portion.

The mounting portion may include a first portion extending from a lateral surface of the tub, and a second portion spaced apart from the first portion and extended from a lateral surface; and the fixing member includes a head supported by the first portion of the mounting portion, and at least one fixing pin extending from the head so as to pass through the mounting portion and the buffering member.

The at least one fixing pin may be formed in a cylindrical shape having a hollow, and the at least one fixing pin and the head may be elastically deformed.

The fixing member may include a separation prevention portion in the at least one fixing pin so as to prevent the fixing member from escaping from the mounting portion.

The separation prevention portion may be formed of an elastic hook caught into the second portion of the mounting portion.

The buffering member may include: a body formed of an elastic material; a first through-hole disposed in the body so as to accommodate the stabilizer bar; and at least one second through-hole disposed in the body so as to accommodate the at least one fixing pin.

The first through-hole may include a cut part through which the stabilizer bar is accommodated through the lateral surface of the first through-hole.

Each of the plurality of suspension units may include a suspension bar and a suspension cap. The stabilizer unit may include a connection member configured to connect the at least one stabilizer bar to the suspension bar. The connection member may include a first accommodation portion to accommodate one end of the stabilizer bar and a second accommodation portion to accommodate the suspension bar.

The first accommodation portion may include: a body through which the stabilizer bar passes; and a coupling portion extending from the body so as to be coupled to the second accommodation portion.

The connection member may include: a buffering member disposed in the body of the first accommodation portion so as to enclose the stabilizer bar.

One end of the body of the first accommodation portion may include an insertion hole in which the buffering member is inserted. The connection member may include a cap mounted to one end of the body of the first accommodation portion so as to prevent separation of the buffering member. The cap may include a through-hole through which the stabilizer bar passes, and a recess to store a lubricant to be supplied to the through-hole.

The other end of the body of the first accommodation portion may include a through-hole through which the stabilizer bar passes, and a recess to store a lubricant to be supplied to the through-hole.

The body of the first accommodation portion may include a catching portion to prevent separation of the cap, and the cap may include a catching hole in which the catching portion is caught.

The second accommodation portion may include: a body to accommodate the suspension bar; and a coupling protrusion through which the second accommodation portion is hinged to the first accommodation portion, wherein the coupling protrusion extends from the body of the second accommodation portion, and the coupling portion of the first accommodation portion includes a coupling hole to accommodate the coupling protrusion.

The coupling portion of the first accommodation portion may include a ramp portion configured to guide the coupling protrusion in a manner that the second accommodation portion is easily snap-coupled. The coupling protrusion of the second accommodation portion may include a tapered part through which the coupling protrusion easily enters the ramp portion.

The body of the second accommodation portion may include a through-hole configured to accommodate the suspension bar, wherein the through-hole includes a cut part through which the suspension bar is accommodated through a lateral surface of the through-hole.

A recess to store a lubricant therein may be provided at the internal surface of the through-hole.

The first accommodation portion may include a temporary fixing portion detachably coupled to the suspension cap.

The suspension cap may include a head supported by the cabinet, and a collar extending from the head so as to accommodate one end of the suspension bar. The temporary fixing portion may include a ring-shaped base connected to one end of the body of the second accommodation portion, and a coupling portion extending from the base so as to accommodate the collar. The coupling portion may be formed in a serrated shape for facilitation of elastic deformation.

In accordance with one aspect of the present disclosure, a washing machine includes: a cabinet; a tub disposed in the cabinet; a suspension unit configured to attenuate vibration of the tub, and connect the tub to the cabinet such that the tub is supported by the cabinet; and a stabilizer unit configured to connect the suspension unit to the tub. The stabilizer unit may include: a V-shaped stabilizer bar, both ends of which are connected to the suspension unit and the tub; a mounting member arranged in a manner that one end of the stabilizer bar is mounted to the tub; and a connection member configured to connect the other end of the stabilizer bar to the suspension unit.

BRIEF DESCRIPTION OF THE DRAWINGS

These and/or other aspects of the invention will become apparent and more readily appreciated from the following description of the embodiments, taken in conjunction with the accompanying drawings of which.

DETAILED DESCRIPTION

Figure 1:
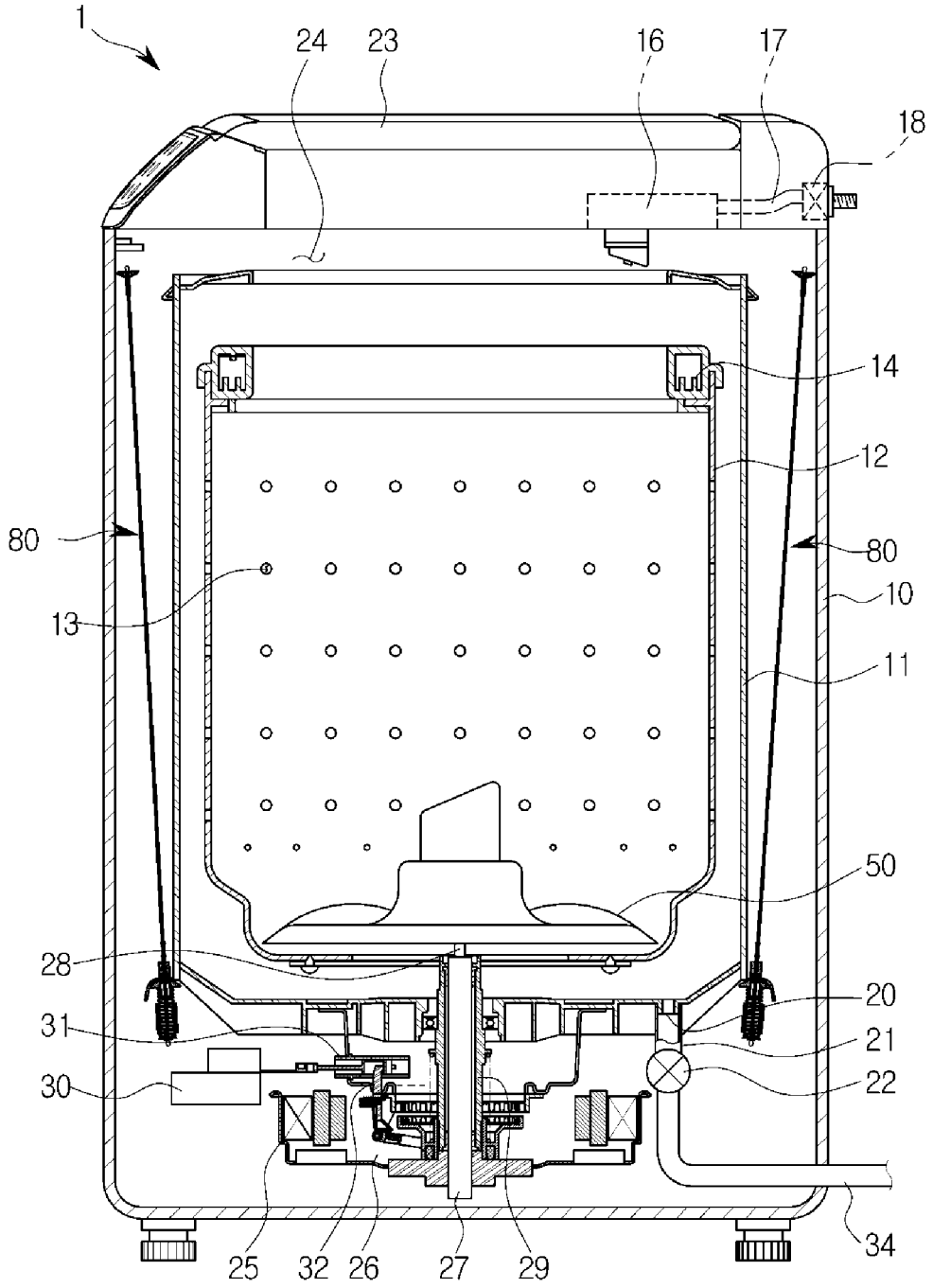
FIG. 1 is a cross-sectional view illustrating a washing machine according to an embodiment of the present disclosure.

Reference will now be made in detail to the embodiments of the present disclosure, examples of which are illustrated in the accompanying drawings, wherein like reference numerals refer to like elements throughout.

Terms "front end", "rear end", "upper part," "lower part," "upper end," and "lower end" are defined based on the drawings and do not limit shapes and positions of components. A singular expression may include a plural expression unless otherwise stated in the context.

FIG. 1 is a cross-sectional view illustrating a washing machine according to an embodiment of the present disclosure.

Referring to FIG. 1, a washing machine 1 includes a cabinet 10 forming an external appearance of the washing machine 1, a tub 11 disposed in the cabinet 10 to store water therein, a washing tub 12 rotatably disposed in the tub 11, and a pulsator 50 disposed in the washing tub 12 to produce a water current.

An introduction port 24, through which laundry is introduced into the washing tub 12, is formed at the top of the cabinet 10. The introduction port 24 is opened and closed by a door 23 mounted at the top of the cabinet 10. The cabinet 10 may be supported on the cabinet 10 by a suspension unit 80.

A water supply pipe 17 to supply wash water to the tub 11 is installed at the upper portion of the tub 11. One side of the water supply pipe 17 is connected to an external water source, and the other side of the water supply pipe 17 is connected to a detergent feed portion 16. Water supplied through the water supply pipe 17 passes through the detergent feed portion 16 and thus water and a detergent are supplied into the tub 11 together. A water supply valve 18 may be installed in the water supply pipe 17 to control supply of water.

The washing tub 12 is formed in the shape of a cylinder having an open top, and multiple spin-dry holes 13 are formed on a lateral surface of the washing tub 12. A balancer 14 may be mounted to the upper portion of the washing tub 12 to ensure stable rotation of the washing tub 12 when the washing tub 12 rotates at a high speed.

Installed at the exterior of the lower portion of the tub 11 are a motor 25 to generate driving force to rotate the washing tub 12 and the pulsator 50, and a power transmission unit 26 to simultaneously or selectively transfer the driving force generated by the motor 25 to the washing tub 12 and the pulsator 50.

A hollow spin-dry shaft 29 may be coupled to the washing tub 12, and a washing shaft 27, which is installed at a hollow portion of the hollow spin-dry shaft 29, may be coupled to the pulsator 50 through a washing shaft coupling portion 28. The motor 25 may simultaneously or selectively transfer the driving force to the washing tub 12 and the pulsator 50 according to the elevation operation of the power transmission unit 26.

The power transmission unit 26 may include an actuator 30 to generate driving force for power transmission, a rod 31 to rectilinearly move according to operation of the actuator 30, and a clutch 32 connected to the rod 31 to rotate according to operation of the rod 31.

A drainage port 20 to discharge wash water stored in the tub 11 may be formed at the bottom of the tub 11, and a first drainage pipe 21 is connected to the drainage port 20. A drainage valve 22 to regulate drainage may be installed at the first drainage pipe 21. The outlet of the drainage valve 22 may be connected to a second drainage pipe 34 to discharge the wash water to the outside.

Figure 2:
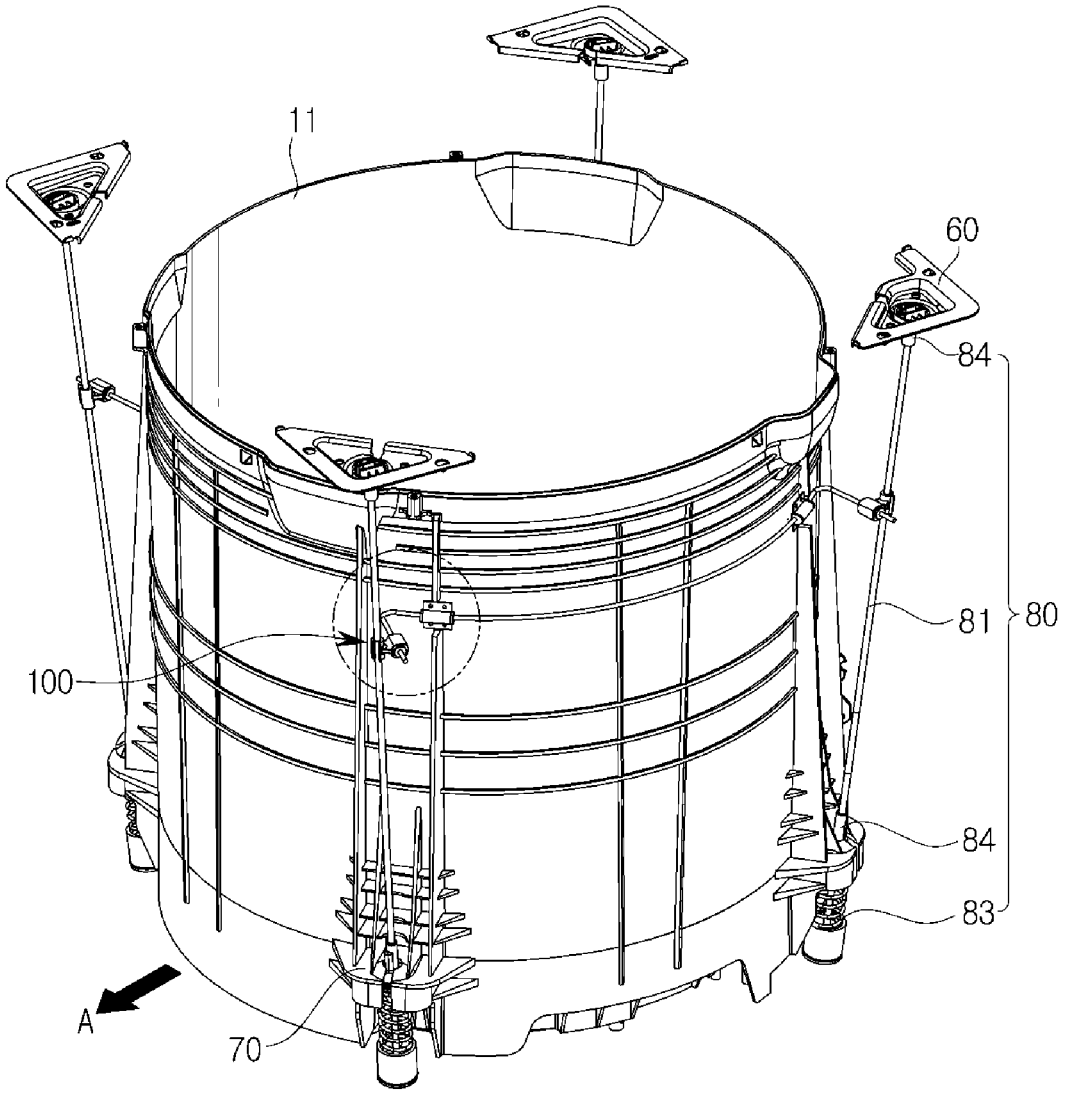
FIG. 2 is a perspective view illustrating a tub, a suspension unit, and a stabilizer unit of the washing machine according to an embodiment of the present disclosure.
Figure 3:
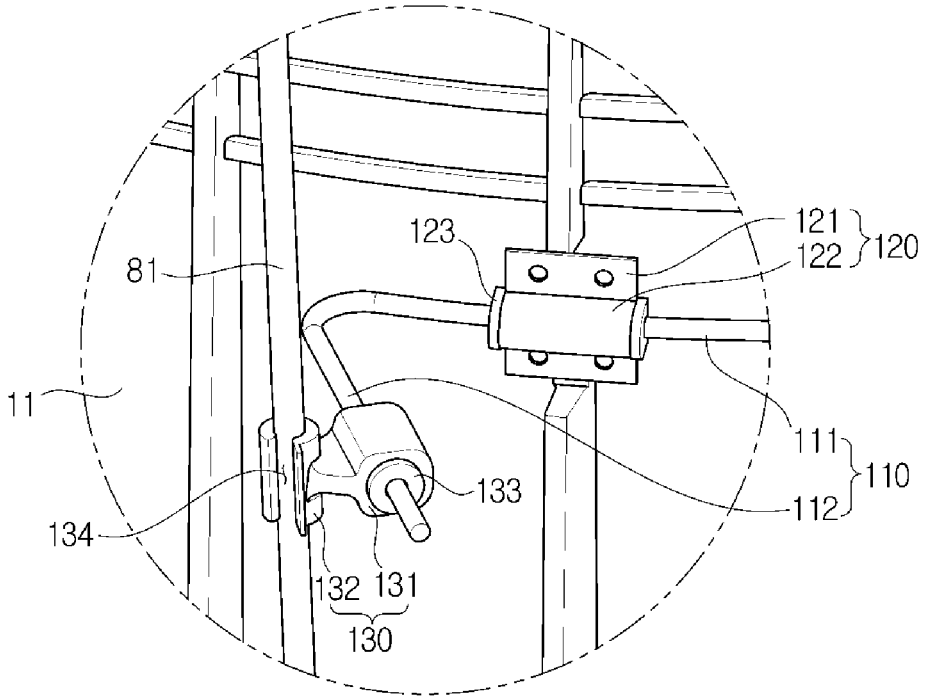
FIG. 3 is an enlarged perspective view illustrating some parts of FIG. 2.

FIG. 2 is a perspective view illustrating a tub, a suspension unit, and a stabilizer unit of the washing machine according to an embodiment of the present disclosure. FIG. 3 is an enlarged perspective view illustrating some parts of FIG. 2. In FIGS. 2 to 10, it is assumed that the direction of an arrow (A) shown in FIG. 2 is set to a forward direction of the washing machine.

The suspension unit 80 may be disposed in the cabinet 10 to attenuate vibration of the tub 11. In more detail, the suspension unit 80 is connected not only to a first holder formed at the upper part of the internal surface of the cabinet 10 but also to a second holder 70 formed at the lower part of the external surface of the tub 11, such that it can absorb or buffer vibration and shock received from the tub 11. The positions of the first holder 60 and the second holder 70 may be changed as necessary.

The suspension unit 80 may include a suspension cap 84, a suspension bar 81, a spring 83, and a damper 82. The suspension cap 84 may be arranged at the top and bottom of the suspension bar 81 in a manner that the suspension bar 81 is easily coupled to the first holder 60 and the second holder 70. The spring 83 and the damper 82 may be provided below the suspension bar 81, and may be contracted and relaxed by vibration and impact received from the tub 11, such that the vibration and impact can be buffered and attenuated.

The stabilizer unit 100 is mounted to the tub 11, and is arranged to interconnect two suspension units 80.

Although the suspension unit 80 may attenuate vertical vibration and horizontal vibration according to the installation angle, the suspension unit 80 can generally attenuate vertical vibration because a vertical vector component has a high value.

The stabilizer unit 100 according to an embodiment of the present disclosure is mounted to the tub 11 so as to horizontally interconnect two suspension units 80, such that horizontal vibration of the tub 11 is attenuated.

Since the stabilizer unit 100 limits the horizontal vibration of the tub 11, the suspension unit 80 is installed at a nearly right angle, resulting in increased capacity of the tub 11 within the cabinet 10. As a result, since the horizontal vibration displacement is small irrespective of a shorter distance between the tub 11 and the cabinet 10, the tub 11 is prevented from contacting the cabinet 10 and noise occurrence can also be prevented.

Referring to FIGS. 2 and 3, the stabilizer unit 100 may include a stabilizer bar 110 having a predetermined length through which two suspension units 80 can be connected to each other, and a mounting member 120 configured to mount the stabilizer bar 110 to the tub 11.

The stabilizer bar 110 may be mounted to the external surface of the tub 11 by the mounting member 120. Preferably, the stabilizer bar 110 may be mounted to the upper portion of the external surface of the tub 11. The stabilizer bar 110 may be formed to have a cross-sectional view having a hollow circular shape, and may be curved to correspond to a curvature of the external surface of the tub 11 in a manner that some parts of the external surface of the cylindrical tub 11 are enclosed by the stabilizer bar 110 in a circumferential direction.

If necessary, two stabilizer bars 110 may be respectively arranged at both sides of the tub 11. That is, the first stabilizer bar 110 may be arranged at one side of the tub 11, and the second stabilizer bar 110 may be arranged at the other side of the tub 11. Each stabilizer bar 110 may be arranged to interconnect two suspension units 80 arranged at the front and rear parts of each side.

The stabilizer bar 110 may include a center part 111 curved and mounted to the external surface of the tub 11, and an end part 112 curved at a predetermined angle in a manner that the stabilizer bar 110 can be connected to the suspension bar 81.

The mounting member 120 may fix the center part 111 of the stabilizer bar 110 at the side surface of the tub 11. The stabilizer bar 110 may rotate about the center axis of the stabilizer bar 110 by the mounting member 120, and may be mounted in a manner that the stabilizer bar 110 can move in the longitudinal direction (i.e., in the circumferential direction of the tub 11) of the stabilizer bar 110 along the external surface of the tub 11.

The mounting member 120 may include a convex part 122 through which the center part of the stabilizer bar 110 passes, and a fixing portion 121 fixed to the tub 11. The mounting member 120 may be fixed to the tub 11 by a fixing member such as a bolt contained in the fixing portion 121. A bush 123 for suppressing vibration and noise generated by contact between the mounting member 120 and the stabilizer bar 110 may be disposed in the convex part 122. The bush 123 may be formed of rubber. The bush 123 may allow the stabilizer bar 110 to minimize translational motion and rotational motion by frictional force.

The stabilizer unit 100 may include a connection member 130 to connect the stabilizer bar 110 to the suspension unit 80. In more detail, the end part 112 of the stabilizer bar 110 may be connected to the suspension bar 81 of the suspension unit 80 through the connection member 130.

The connection member 130 may be formed of a plastic material. The connection member 130 may include a first accommodation portion 131 to accommodate the end part 112 of the stabilizer bar 110, and a second accommodation portion 132 to accommodate the suspension bar 81. The end part 112 of the stabilizer bar 110 may pass through the first accommodation portion 131 of the connection member 130.

The end part 112 of the stabilizer bar 110 may rotate about the center axis of the stabilizer bar 110 within the first accommodation portion 131, and may perform the translational motion in the longitudinal direction. In addition, the suspension bar 81 may pass through the second accommodation portion 132 of the connection member 130, such that the connection member 130 can perform the rotational motion on the basis of the suspension bar 81 and can also perform the translational motion in the longitudinal direction of the suspension bar 81.

The first accommodation portion 131 of the connection member 130 may include a bush 133 to suppress vibration and noise generated by contact with the stabilizer bar 110. The bush 133 may be formed of rubber. The bush 133 may allow the end part 112 of the stabilizer bar 110 to minimize the translational motion and the rotational motion by frictional force. In addition, the second accommodation portion 132 of the connection member 130 may include a cut part 134 through which the connection member 130 can be snap-coupled to the suspension bar 81.

The center part 111 of the stabilizer bar 110 is coupled to the tub 11, and both end parts 112 are coupled to the suspension bar 81, such that bending force and torsional force may be applied to the stabilizer bar 110 by movement of the tub 11. Specifically, if the dehydration speed increases on the condition that unbalance mass is applied to the washing tub 12 after completion of the washing or rinsing process, vibration is amplified in a transition section by resonance, such that horizontal and vertical vibration displacements unavoidably increase. In this case, torsional force and bending force occur in the stabilizer bar 110, such that the increasing displacement of the tub 11 can be reduced by the attenuation effect acquired by the stabilizer bar 110. Tub displacement increased by the attenuation effect of the stabilizer bar 110 can be reduced. Of course, the increase of tub displacement according to excessive tangled laundry is attenuated during the washing process, resulting in reduction in tub displacement.

Figure 4A:
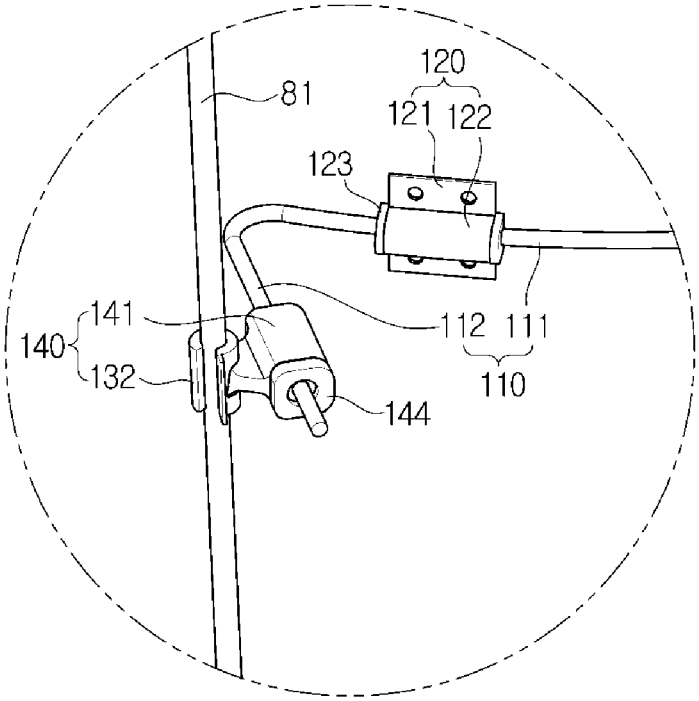
FIG. 4A is a perspective view illustrating a connection member of the stabilizer unit.
Figure 4B:
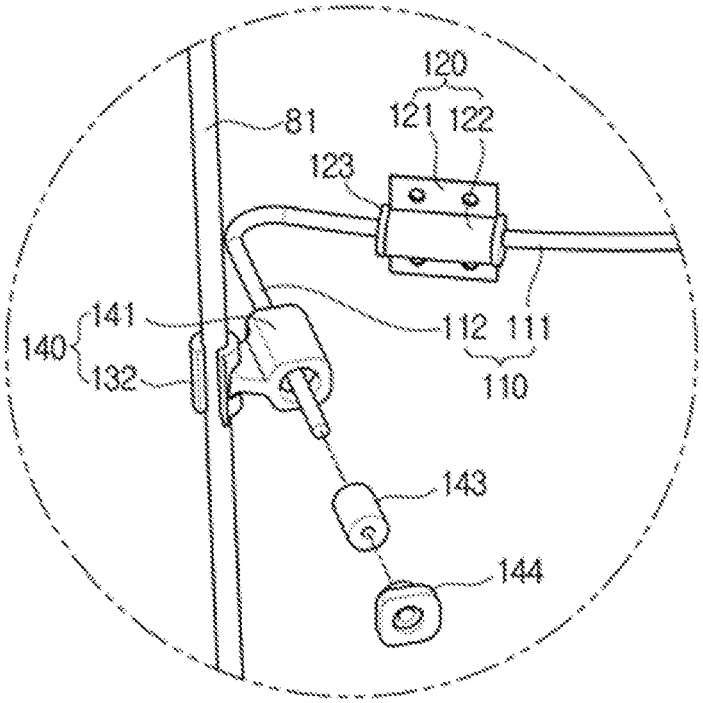
FIG. 4B is an exploded view of the connection member of FIG. 4A.

FIG. 4A is a perspective view illustrating a connection member of the stabilizer unit. FIG. 4B is an exploded view of the connection member of FIG. 4A.

The connection member 140 shown in FIGS. 4A and 4B may be formed in shape and constituent material in a similar way to the connection member 130 shown in FIGS. 2 and 3. The same characteristics between the connection member 140 of FIGS. 4A and 4B and the connection member 130 of FIGS. 2 and 3 will herein be omitted for convenience of description. A felt 143, instead of the bush formed of rubber, may be disposed in the first accommodation portion 141 of the connection member 140 shown in FIGS. 4A and 4B. In addition, a cap 144 may be disposed at one end of the first accommodation portion 141 so as to prevent separation of the felt 143. The felt 143 may function as a frictional damper (such as a rubber bush) configured to suppress vibration and noise.

Figure 5A:
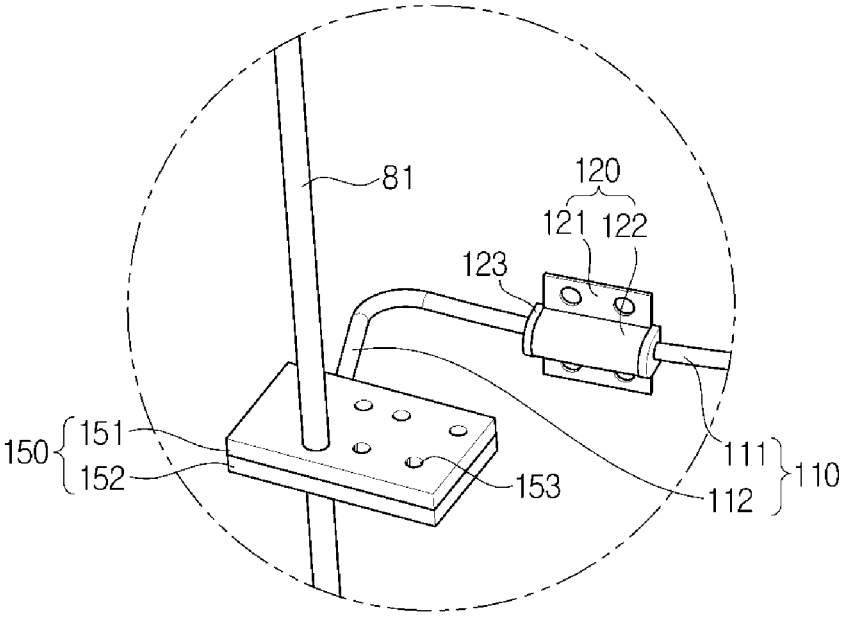
FIG. 5A is a perspective view illustrating a connection member of the stabilizer unit according to another embodiment of the present disclosure.
Figure 5B:
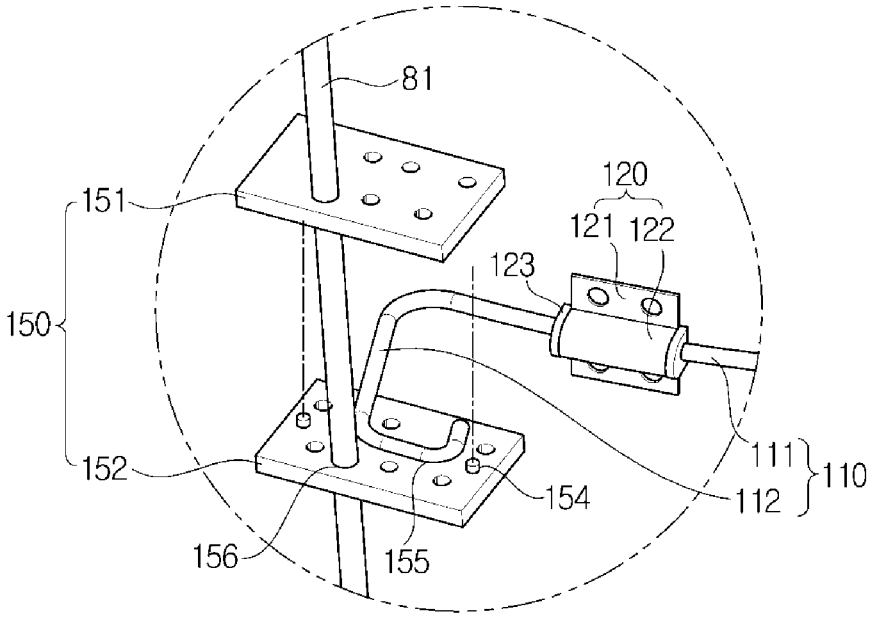
FIG. 5B is an exploded view illustrating the connection member of FIG. 5A.
Figure 6A:
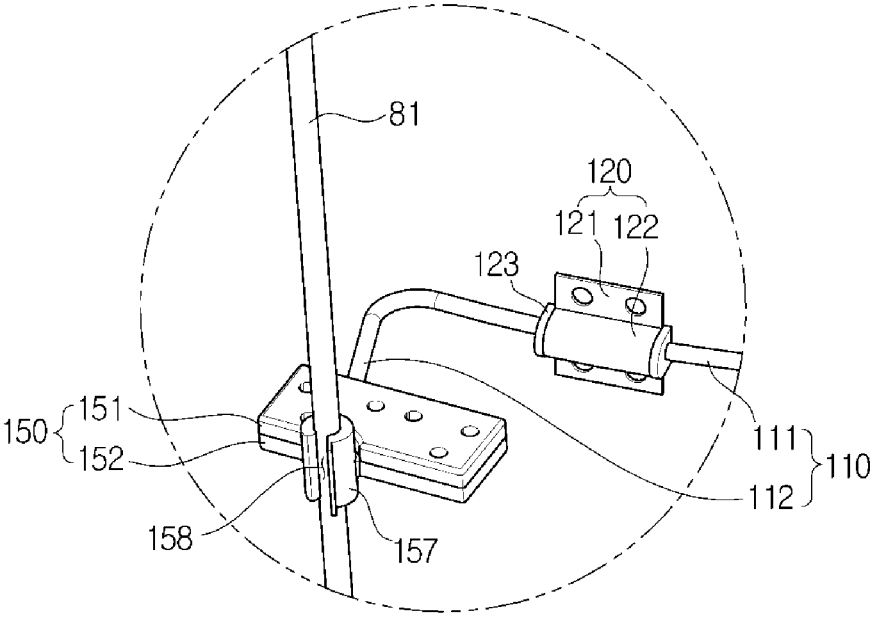
FIG. 6A is a perspective view illustrating a connection member of the stabilizer unit according to another embodiment of the present disclosure.
Figure 6B:
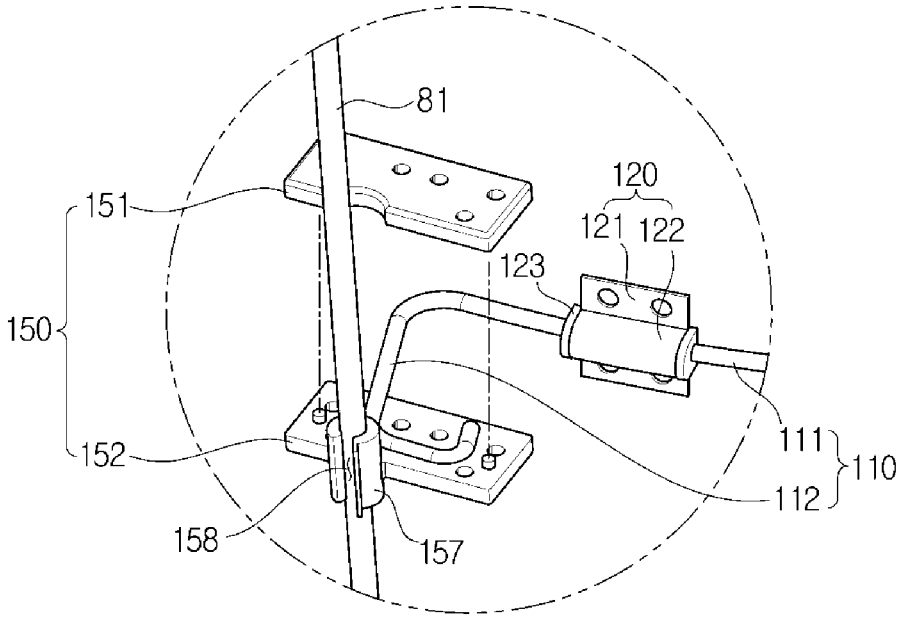
FIG. 6B is an exploded view illustrating the connection member of FIG. 6A.

FIG. 5A is a perspective view illustrating a connection member of the stabilizer unit according to another embodiment of the present disclosure. FIG. 6A is a perspective view illustrating a connection member of the stabilizer unit according to another embodiment of the present disclosure. FIG. 6B is an exploded view illustrating the connection member of FIG. 6A. FIG. 5B is an exploded view illustrating the connection member of FIG. 5A.

The connection member 150 shown in FIGS. 5A and 6B may be formed of a plastic material. The connection member 150 may be formed by connection between the upper portion 151 and the lower portion 152. The upper portion 151 may be connected to the lower portion 152 through a coupling member such as a screw. Therefore, several connection holes 153 may be formed in the connection member 150. In addition, a connection protrusion 154 and a connection groove (not shown) may be provided to assist correct connection between the upper portion 151 and the lower portion 152.

The connection member 150 may include a first accommodation portion 155 to accommodate the end part 112 of the stabilizer bar 110 and a second accommodation portion 156 to accommodate the suspension bar 81. The end part 112 of the stabilizer bar 110 may be bent at least once to prevent the rotational motion and the translational motion, and then accommodated in the first accommodation portion 155 of the connection member 150.

The suspension bar 81 may pass through the second accommodation portion 156 of the connection member 150, such that the connection member 150 can perform the rotational motion about the suspension bar 81 and can perform the translational motion in the longitudinal direction of the suspension bar 81.

The second accommodation portion 156 of the connection member 150 shown in FIGS. 5A and 5B may be formed to include through-holes through which the suspension bar 81 passes. The second accommodation portion 157 of the connection member 150 shown in FIGS. 6A and 6B may include a cut part 158 through which the connection member 150 is snap-coupled to the suspension bar 81.

Figure 7:
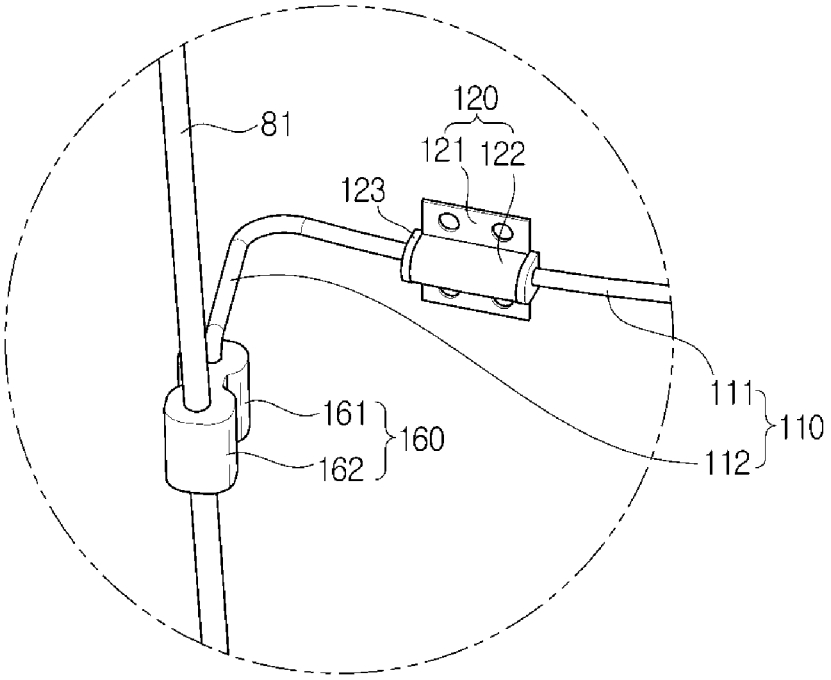
FIG. 7 is a perspective view illustrating a connection member of the stabilizer unit according to another embodiment of the present disclosure.
Figure 8A:
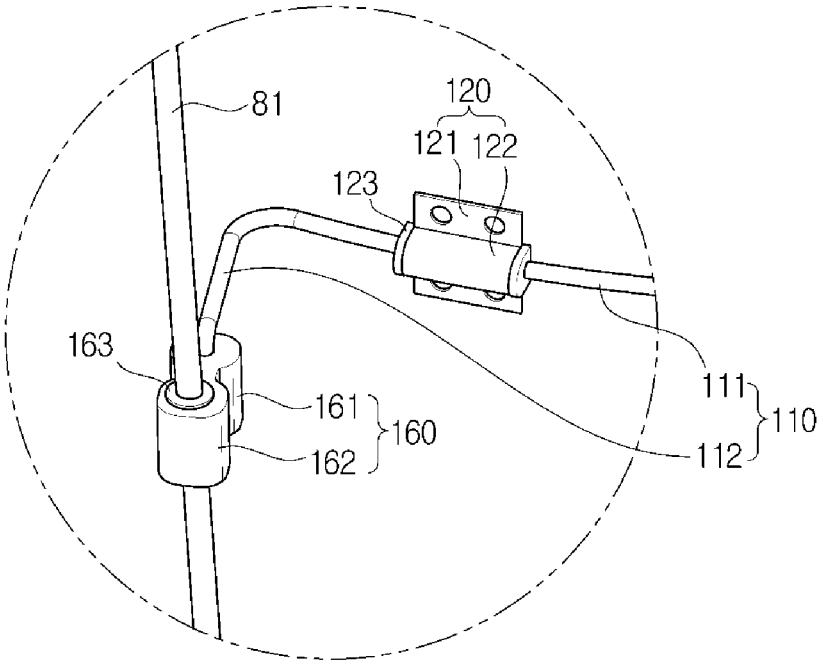
FIG. 8A is a perspective view illustrating a connection member of the stabilizer unit according to another embodiment of the present disclosure.
Figure 8B:
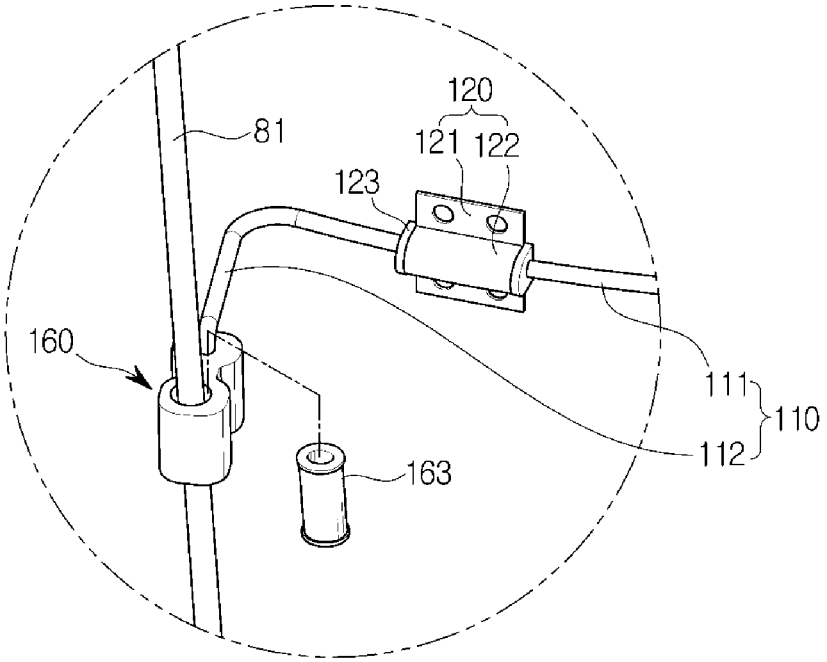
FIG. 8B is an exploded view illustrating the connection member of FIG. 8A.

FIG. 7 is a perspective view illustrating a connection member of the stabilizer unit according to another embodiment of the present disclosure. FIG. 8A is a perspective view illustrating a connection member of the stabilizer unit according to another embodiment of the present disclosure. FIG. 8B is an exploded view illustrating the connection member of FIG. 8A.

The connection member 160 shown in FIGS. 7 and 8B may be formed of rubber. The connection member 160 may include a first accommodation portion 161 to accommodate the end part 112 of the stabilizer bar 110 and a second accommodation portion 162 to accommodate the suspension bar 81. The first accommodation portion 161 and the second accommodation portion 162 of the connection member 160 may be formed in through-holes arranged in parallel to each other.

The end part 112 of the stabilizer bar 110 accommodated in the first accommodation portion 161 of the connection member 160 may be bent to be arranged in parallel to the suspension bar 81, and may pass through the first accommodation portion 161. The end part 112 of the stabilizer bar 110 may rotate about the center axis of the stabilizer bar 110 in the first accommodation portion 161 of the connection member 160, and may also perform the translational motion in the longitudinal direction in the first accommodation portion 161 of the connection member 160.

Since the connection member 160 is formed of rubber, vibration and noise generated by contact with the stabilizer bar 110 can be suppressed, and the end part 112 of the stabilizer bar 110 can minimize the longitudinal translational motion and the rotational motion by frictional force.

In addition, the suspension bar 81 may be arranged to pass through the second accommodation portion 162 of the connection member 160, such that the connection member 160 can rotate about the suspension bar 81 and can also perform the translational motion in the longitudinal direction of the suspension bar 81.

The connection member 160 of FIG. 7 does not include an additional bush in the second accommodation portion 162, such that the longitudinal translational motion and rotational motion of the suspension bar 81 can be minimized by frictional force. In the meantime, a separate bush 163 formed of plastic may be disposed in the second accommodation portion 162 of the connection member 160 shown in FIGS. 8A and 8B, such that the connection member 160 can easily perform the longitudinal translational motion and rotational motion of the suspension bar 81.

Figure 9:
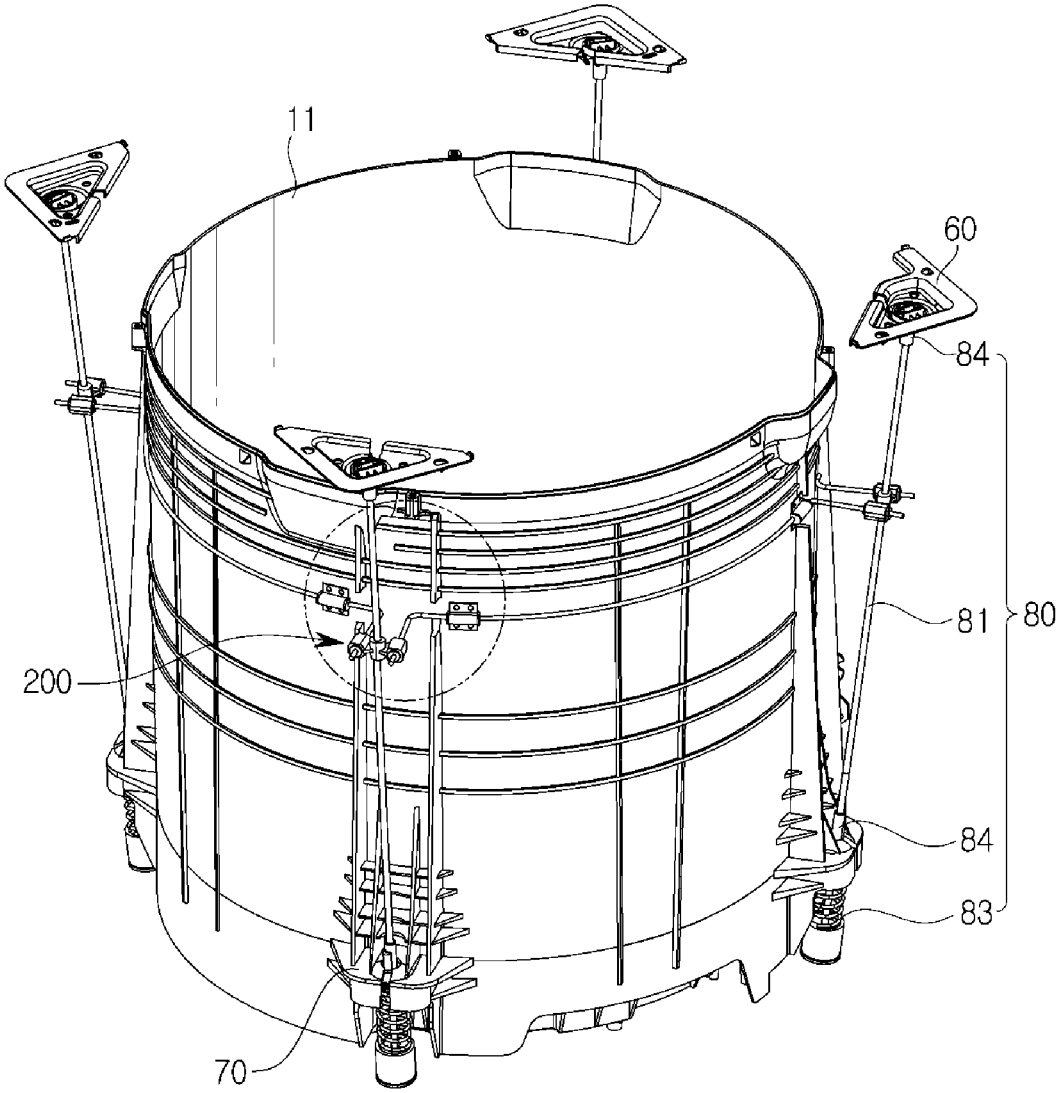
FIG. 9 is a perspective view illustrating a tub, a suspension unit, and a stabilizer unit of the washing machine according to another embodiment of the present disclosure.
Figure 10:
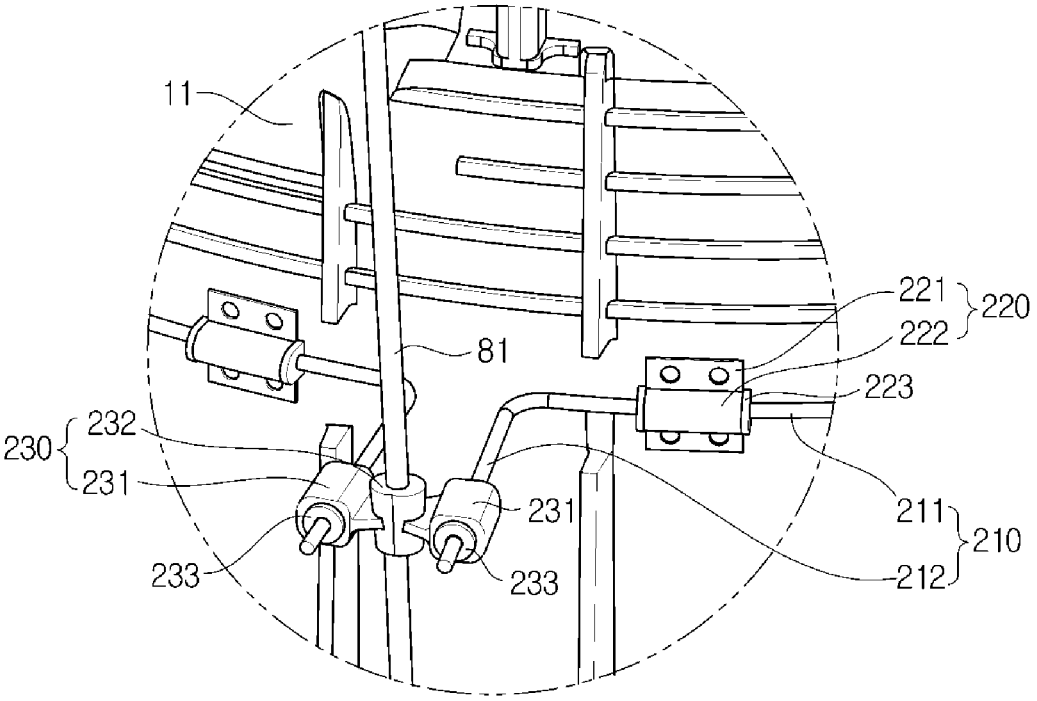
FIG. 10 is an enlarged perspective view illustrating some parts of FIG. 9.

FIG. 9 is a perspective view illustrating a tub, a suspension unit, and a stabilizer unit of the washing machine according to another embodiment of the present disclosure. FIG. 10 is an enlarged perspective view illustrating some parts of FIG. 9.

The tub and the suspension unit of the washing machine shown in FIG. 9 are identical in structure to those of the washing machine shown in FIG. 2, and as such a detailed description thereof will herein be omitted for convenience of description.

Referring to FIGS. 9 and 10, the stabilizer unit 200 may include a stabilizer bar 210 having a predetermined length through which two suspension units 80 can be connected to each other, and a mounting member 120 configured to mount the stabilizer bar 210 to the tub 11.

The stabilizer bar 210 may be mounted to the external surface of the tub 11 by the mounting member 220. Preferably, the stabilizer bar 210 may be mounted to the upper portion of the external surface of the tub 11. The stabilizer bar 210 may be formed to have a cross-sectional view having a hollow circular shape, and may be curved to correspond to a curvature of the external surface of the tub 11 in a manner that some parts of the external surface of the tub 11 are enclosed by the stabilizer bar 110 in the circumferential direction.

If necessary, two stabilizer bars 210 may be arranged at four sides (front, rear, left, right) of the tub 11, and each stabilizer bar 210 may be arranged to interconnect two adjacent suspension units 80. That is, the front stabilizer bar 210 may interconnect left and right suspension units 80 arranged in a forward direction of the tub 11, the left stabilizer bar 210 may interconnect front and rear suspension units 80 arranged in a left direction of the tub 11, the right stabilizer bar 210 may interconnect front and rear suspension units 80 arranged in a right direction of the tub 11, and the rear stabilizer bar 210 may interconnect left and right suspension units 80 in a backward direction of the tub 11.

The stabilizer bar 210 may include a center part 211 curved and mounted to the external surface of the tub 11, and an end part 212 curved at a predetermined angle is disposed at both ends of the stabilizer bar 210 such that the end part 212 is connected to the suspension bar 81.

The mounting member shown in FIGS. 9 and 10 may be identical in structure and shape to those of FIGS. 2 and 3, and as such a detailed description thereof will herein be omitted for convenience of description.

Referring to FIGS. 9 and 10, the stabilizer unit 200 may include a connection member 230 to connect the stabilizer bar 210 to the suspension bar 81. In more detail, the end part 212 of the stabilizer bar 210 may be connected to the suspension bar 81 of the suspension unit 80 through the connection member 230. Two stabilizer bars 210 must be connected to one suspension unit 80, such that the connection member 230 may include two first accommodation portions 231, each of which accommodates the end part 212 of the stabilizer bar 210, and one second accommodation portion 232 to accommodate the suspension bar 81.

The end part 212 of the stabilizer bar 210 may pass through the first accommodation portion 231 of the connection member 230, such that the end part 212 of the stabilizer bar 210 may rotate about the center axis of the stabilizer bar 210 within the first accommodation portion 231 and may also perform the translational motion in the longitudinal direction. In addition, the suspension bar 81 may pass through the second accommodation portion 232 of the connection member 230, such that the connection member 230 can perform the rotational motion on the basis of the suspension bar 81 and can also perform the translational motion in the longitudinal direction of the suspension bar 81.

The first accommodation portion 231 of the connection member 230 may include a bush 233 to suppress vibration and noise generated by contact with the stabilizer bar 210. The bush 233 may be formed of rubber. The bush 133 may allow the end part 212 of the stabilizer bar 210 to minimize the longitudinal translational motion and rotational motion by frictional force. Although not shown in the drawings, the second accommodation portion 232 of the connection member 230 may include a cut part through which the connection member 230 can be snap-coupled to the suspension bar 81.

Figure 11:
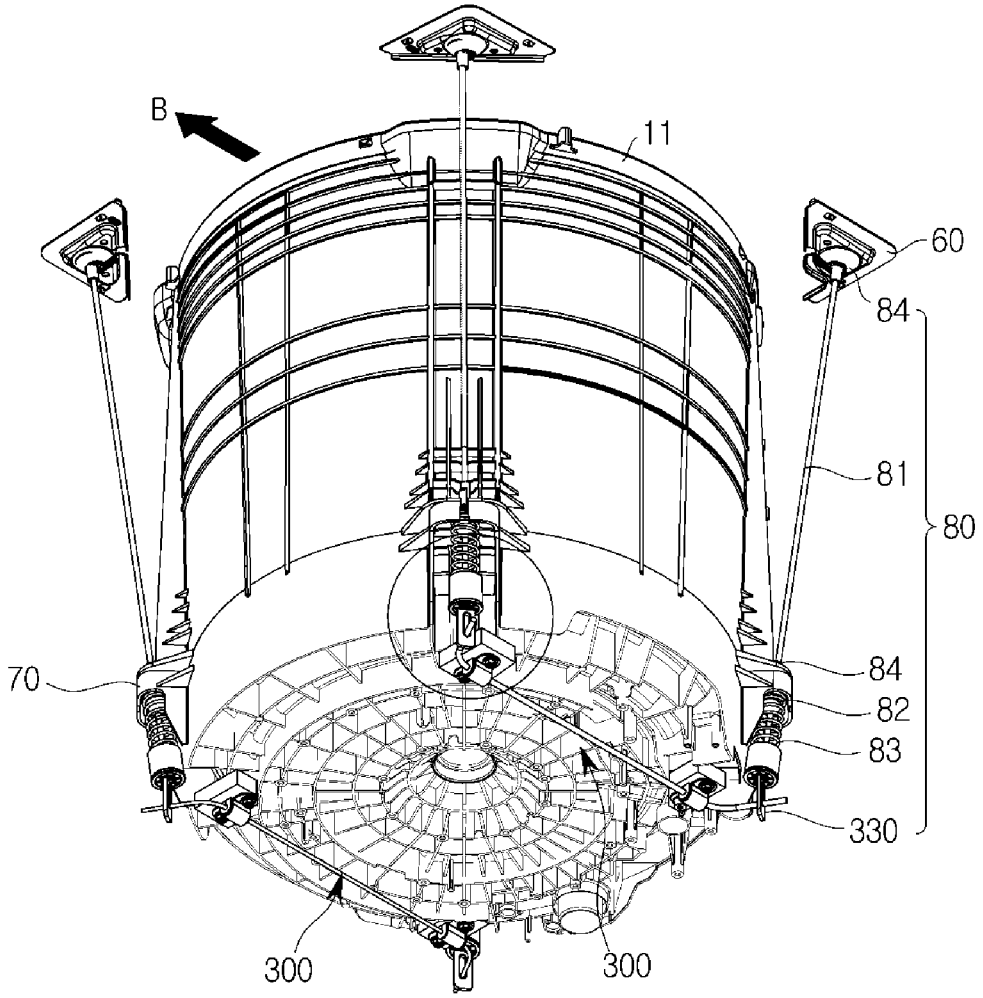
FIG. 11 is a perspective view illustrating a tub, a suspension unit, and a stabilizer unit of the washing machine according to another embodiment of the present disclosure.
Figure 12:
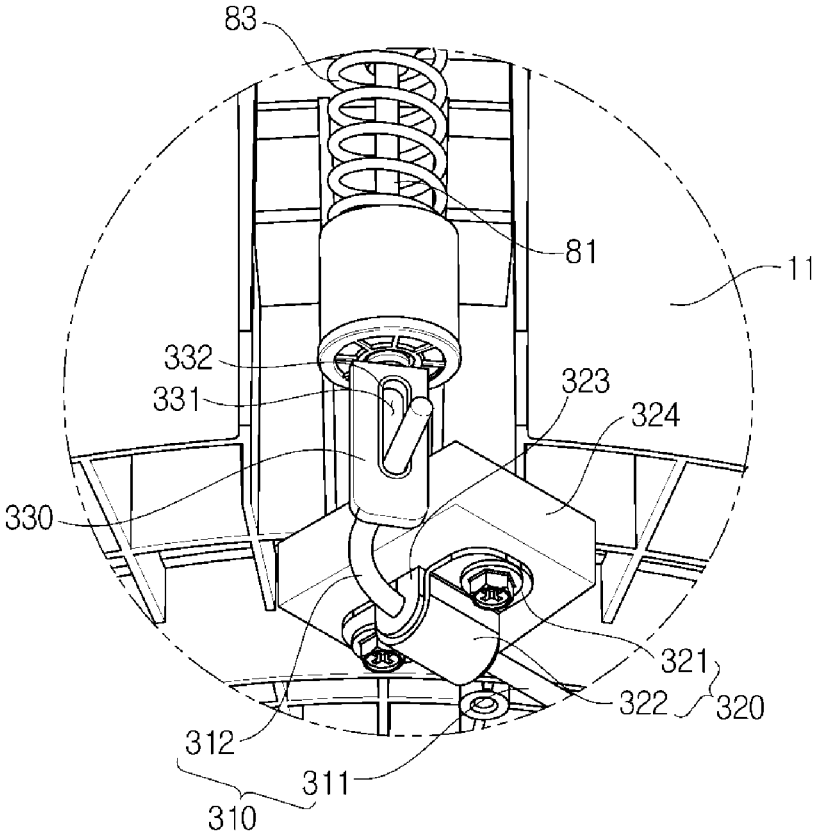
FIG. 12 is an enlarged perspective view illustrating some parts of FIG. 11.
Figure 13:
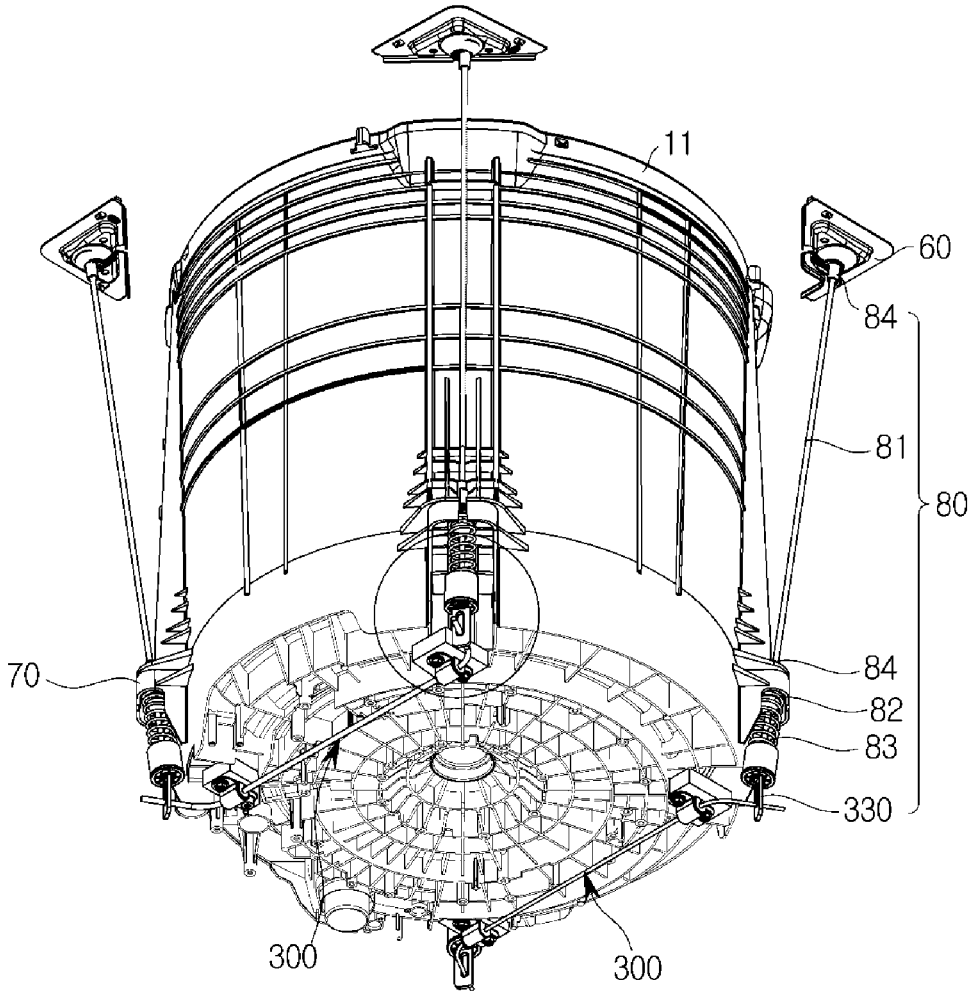
FIG. 13 is a perspective view illustrating a tub, a suspension unit, and a stabilizer unit of the washing machine according to another embodiment of the present disclosure.

FIG. 11 is a perspective view illustrating a tub, a suspension unit, and a stabilizer unit of the washing machine according to another embodiment of the present disclosure. FIG. 12 is an enlarged perspective view illustrating some parts of FIG. 11. FIG. 13 is a perspective view illustrating a tub, a suspension unit, and a stabilizer unit of the washing machine according to another embodiment of the present disclosure. In FIGS. 11 to 13, it is assumed that the direction of an arrow (B) shown in FIG. 11 is set to a forward direction of the washing machine.

The tub and the suspension unit of the washing machine shown in FIGS. 11 to 13 are identical in structure to those of the washing machine shown in FIG. 2, and as such a detailed description thereof will herein be omitted for convenience of description.

Referring to FIGS. 11 to 13, the stabilizer unit 300 may include a stabilizer bar 310 having a predetermined length through which two suspension units 80 can be connected to each other, and a mounting member 320 configured to mount the stabilizer bar 310 to the tub 11.

The stabilizer bar 310 may be formed to have a cross-sectional view having a hollow circular shape. The stabilizer bar 310 may be mounted to the bottom surface of the tub 11 by the mounting member 320.

Referring to FIGS. 11 and 12, two stabilizer bars 310 may be respectively arranged at both sides of the tub 11. That is, the first stabilizer bar 310 and the second stabilizer bar 310 may be respectively arranged in parallel at left and right sides of the bottom surface of the tub 11, and each of the first and second stabilizer bars 310 may be arranged to interconnect two suspension units 80 arranged at the front and rear parts of each side.

Referring to FIG. 13, two stabilizer bars 310 may be respectively arranged in parallel at front and rear sides of the bottom surface of the tub 11, and each stabilizer bar 310 may be arranged to interconnect two suspension units 80 arranged at the left and right parts of each side.

The stabilizer bar 310 may include a center part 311 mounted to the bottom surface of the tub 11, and an end part 312 curved at a predetermined angle in a manner that the stabilizer bar 310 is connected to the suspension bar 81.

The mounting member 320 may fix the center part 311 of the stabilizer bar 310 to the bottom surface of the tub 11. The stabilizer bar 310 may rotate about the center axis of the stabilizer bar 310 by the mounting member 320, and may be mounted in a manner that the stabilizer bar 310 can move in the longitudinal direction thereof.

The mounting member 320 may include a convex part 322 through which the center part 311 of the stabilizer bar 310 passes, and a fixing portion 121 fixed to the tub 11. If necessary, an auxiliary member 324 configured to fix the mounting member 320 may be provided at the bottom of the tub. The mounting member 320 may be fixed to either the tub 11 or the auxiliary member 324 mounted to the tub 11 by a fixing member such as a bolt contained in the fixing portion 321. A bush 323 for suppressing vibration and noise caused by contact between the mounting member 320 and the stabilizer bar 310 may be disposed in the convex part 322. The bush 323 may be formed of rubber. The bush 323 may also allow the stabilizer bar 310 to minimize the longitudinal translational motion and rotational motion by frictional force.

The suspension unit 80 may include a connection portion 330 to connect the stabilizer bar 310 to the suspension unit 80. In more detail, the end part 312 of the stabilizer bar 310 may be connected to the connection portion 330 provided at the lower end of the suspension unit 80.

The connection portion 330 may be incorporated with the suspension bar 81 in one body, and may include an accommodation hole 331 to accommodate the end part 312 of the stabilizer bar 310 therein. The end part 312 of the stabilizer bar 310 may pass through the accommodation hole 331 of the connection portion 330, may rotate about the center axis of the stabilizer bar 310 in the accommodation hole 331 of the connection portion 330, and may also perform the longitudinal translational motion. In addition, the accommodation hole 331 of the suspension unit 80 may be elongated in the longitudinal direction of the suspension bar 81, and the stabilizer bar 310 may move in the longitudinal direction of the suspension unit 80.

A bush 332 for suppressing vibration and noise generated by contact with the stabilizer bar 310 may be disposed in the accommodation hole 331 of the connection portion of the suspension unit 80. The bush 332 may be formed of rubber.

Although not shown in the drawings, an additional device to prevent the end part 312 of the stabilizer bar 310 from arbitrarily escaping from the connection portion 330 of the suspension unit 80 may be provided as necessary. In accordance with one embodiment, a screw thread may be formed in the end part 312 of the stabilizer bar 310, and the end part 312 of the stabilizer bar 310 passes through the accommodation hole 331 and is then fixed by a screw.

Although not shown in the drawings, the stabilizer unit 100 of FIG. 2 or the stabilizer unit 200 of FIG. 9, and the stabilizer unit 300 of FIG. 11 or 13 may be respectively arranged at the lateral surface and the bottom surface of one tub 11.

Figure 14:
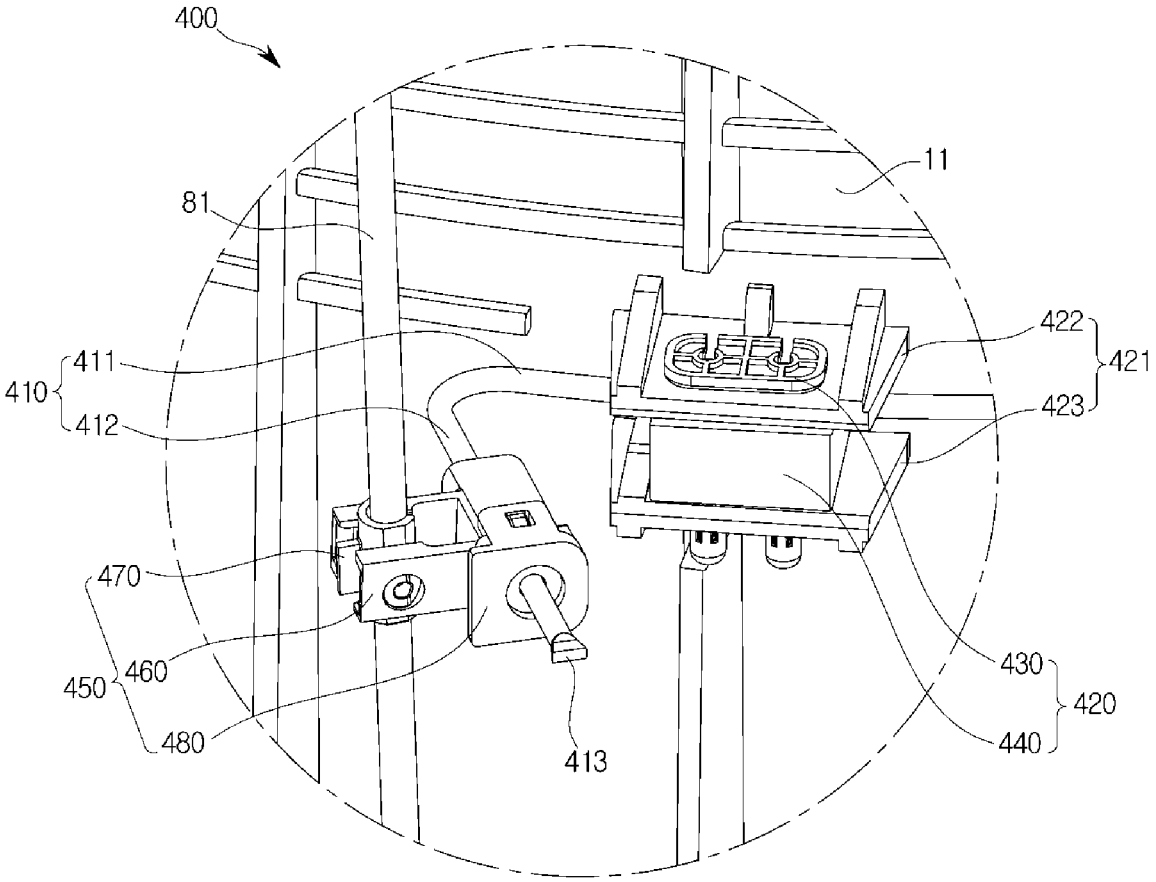
FIG. 14 is a perspective view illustrating a stabilizer unit mounted to a tub of a washing machine according to another embodiment of the present disclosure.
Figure 15:
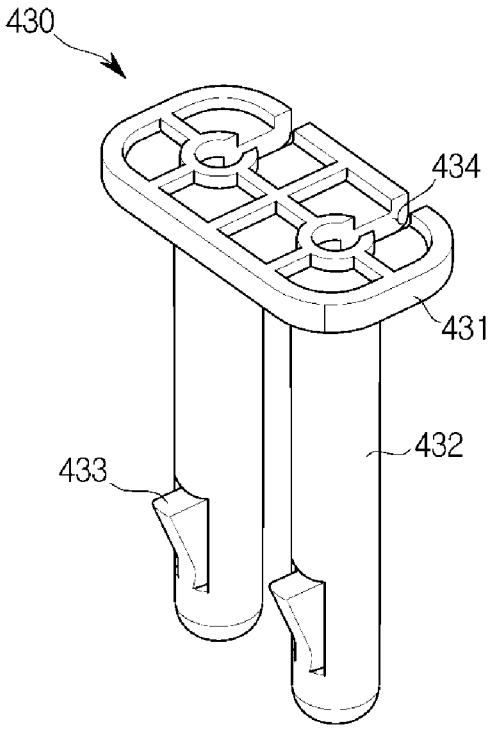
FIG. 15 is a perspective view illustrating one surface of a fixing member of the stabilizer unit of FIG. 14.
Figure 16:
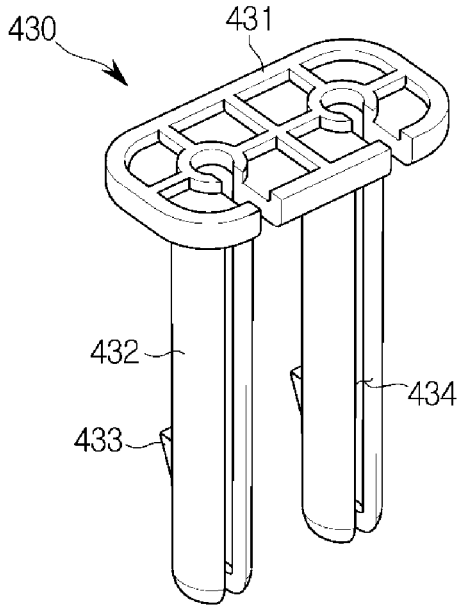
FIG. 16 is a perspective view illustrating the other surface of the fixing member of FIG. 15.
Figure 17:
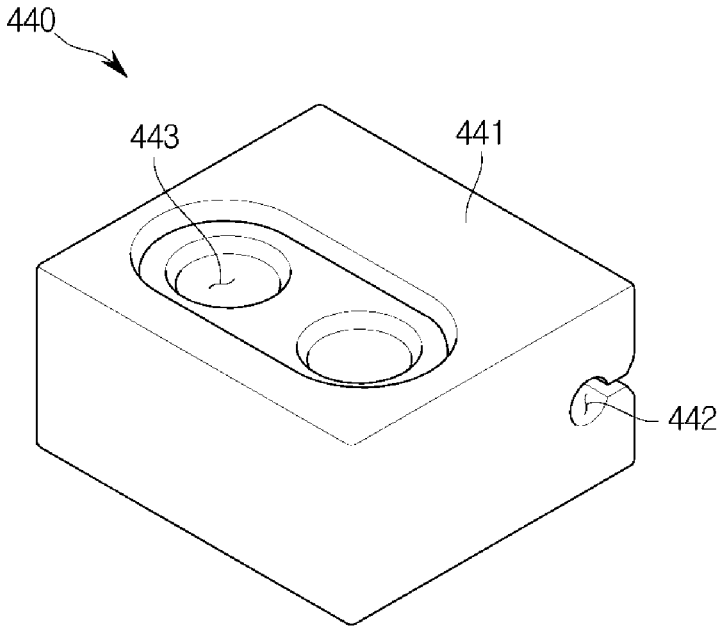
FIG. 17 is a perspective view illustrating a buffering member of the stabilizer unit of FIG. 14.
Figure 18:
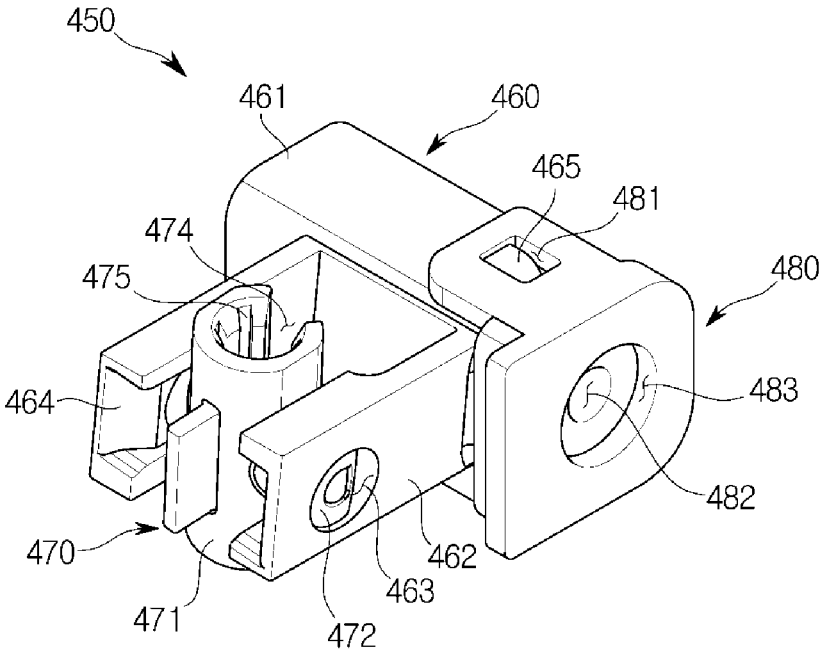
FIG. 18 is a perspective view illustrating a connection member of the stabilizer of FIG. 14.
Figure 19:
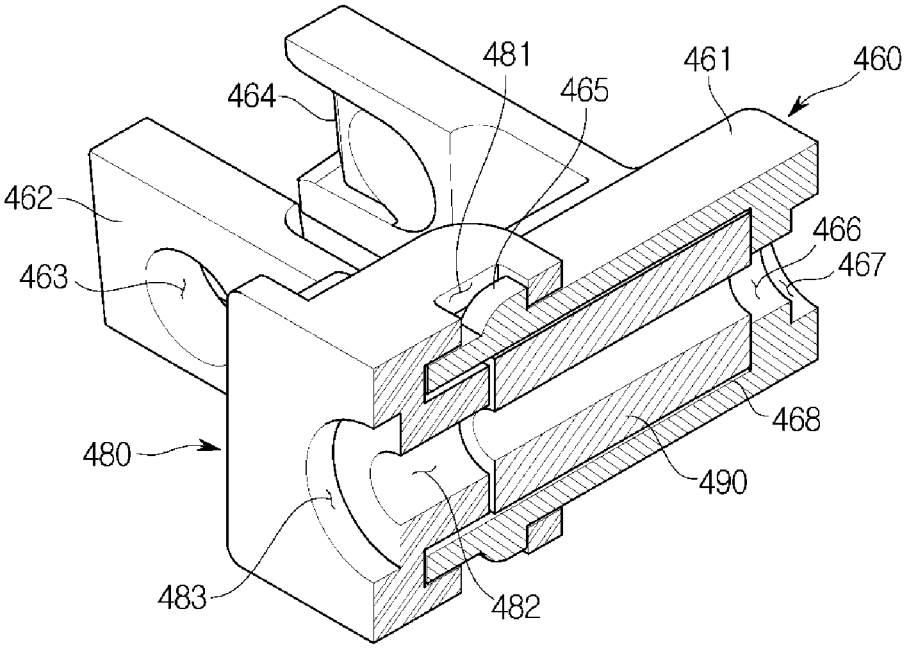
FIG. 19 is a cross-sectional view illustrating a first accommodation portion of the connection member of FIG. 18.
Figure 20:
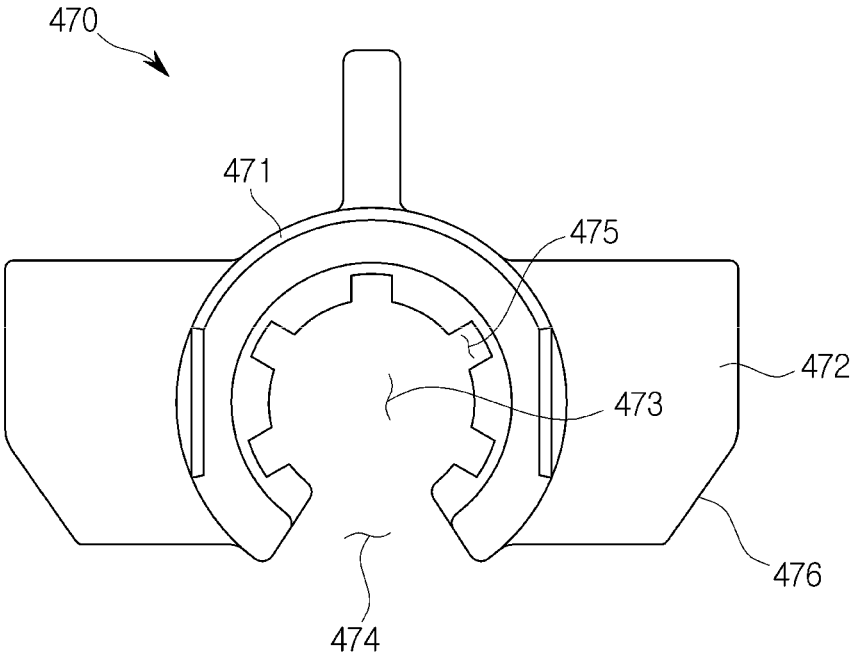
FIG. 20 is a top view illustrating a second accommodation portion of the connection member of FIG. 18.

FIG. 14 is a perspective view illustrating a stabilizer unit mounted to a tub of a washing machine according to another embodiment of the present disclosure. FIG. 15 is a perspective view illustrating one surface of a fixing member of the stabilizer unit of FIG. 14. FIG. 16 is a perspective view illustrating the other surface of the fixing member of FIG. 15. FIG. 17 is a perspective view illustrating a buffering member of the stabilizer unit of FIG. 14. FIG. 18 is a perspective view illustrating a connection member of the stabilizer of FIG. 14. FIG. 19 is a cross-sectional view illustrating a first accommodation portion of the connection member of FIG. 18. FIG. 20 is a top view illustrating a second accommodation portion of the connection member of FIG. 18.

The tub and the suspension unit of the washing machine shown in FIGS. 14 to 19 are identical in structure to those of the washing machine shown in FIG. 2, and as such a detailed description thereof will herein be omitted for convenience of description.

Referring to FIGS. 2 and 14, the stabilizer unit 400 may be mounted to the tub 11, and may interconnect two suspension units 80. In addition, the stabilizer unit 400 may include a stabilizer bar 410 having a predetermined length through which two suspension units 80 can be connected to each other, and a mounting member 420 configured to mount the stabilizer bar 410 to the tub 11.

A mounting portion 421 to which the stabilizer bar 410 can be mounted may be provided at the external surface of the tub 11. The stabilizer bar 410 may be mounted to the mounting portion 421 of the tub 11 by the mounting member 420. Preferably, the stabilizer bar 410 may be mounted to the upper portion of the external surface of the tub 11.

The stabilizer bar 410 may be formed to have a cross-sectional view having a hollow circular shape, and may be curved to correspond to a curvature of the external surface of the tub 11 in a manner that some parts of the external surface of the cylindrical tub 11 are enclosed by the stabilizer bar 110 in the circumferential direction.

If necessary, two stabilizer bars 410 may be respectively arranged at left and right sides of the tub 11. Each stabilizer bar 410 may be arranged to interconnect two suspension units 80 arranged at the front and rear parts of each side.

The stabilizer bar 410 may include a center part 411 curved and mounted to the external surface of the tub 11, and an end part 412 curved at a predetermined angle in a manner that the stabilizer bar 410 can be connected to the suspension bar 81.

The mounting member 420 may fix the center part 411 of the stabilizer bar 410 at the side surface of the tub 11. The stabilizer bar 410 may rotate about the center axis of the stabilizer bar 410 by the mounting member 420, and may be mounted in a manner that the stabilizer bar 410 can move in the longitudinal direction (i.e., in the circumferential direction of the tub 11) of the stabilizer bar 410 along the external surface of the tub 11.

The mounting member 120 may include a buffering member 440 through which the center part of the stabilizer bar 410 passes, and a fixing member 430 configured to fix the buffering member 440 to the mounting portion 421.

The mounting portion 421 may include a first portion 422 elongated from the lateral surface of the tub 11, and a second portion 423 elongated from the lateral surface of the tub 11 at a specific position at which the second portion 423 is spaced apart from the first portion 422 by a predetermined distance so as to accommodate the buffering member 440. The buffering member 440 may be disposed between the first portion 422 and the second portion 423.

The buffering member 440 may be formed of rubber in such a manner that the stabilizer bar 410 can minimize the longitudinal translational motion and rotational motion and vibration and noise caused by contact between the stabilizer bar 410 and the tub 11 can be suppressed.

Referring to FIGS. 15 and 16, the fixing member 430 may include a head 431 supported by the top surface of the first portion 422 of the mounting portion 421, and at least one fixing pin 432 elongated from the head 431 to pass through the mounting portion 421 and the buffering member 440.

Preferably, the fixing member 430 may include two fixing pins 432. If the buffering member 440 is fixed to the mounting portion 421 by two fixing pins 432, the buffering member 440 can be prevented from rotating on the condition that the buffering member 440 is mounted to the mounting portion 421.

The fixing member 430 may be formed of a plastic material, and each fixing pin 432 may be formed in a hollow cylindrical shape. The fixing member 430 may include a cut part 434 provided in each of the fixing pin 432 and the head 431 in a manner that the fixing member 430 can be elastically deformed by external force.

In addition, a separation prevention portion 433 configured to prevent the fixing member 430 from escaping from the mounting portion 421 may be provided at a lower part of the fixing pin 432. The separation prevention portion 433 may be formed in the shape of an elastic hook, the fixing pin 432 may pass through the mounting portion 421 and may be caught in the bottom surface of the second portion 423 of the mounting portion 421.

Referring to FIG. 17, the buffering member 440 may include a body 441 formed of an elastic material such as rubber, a first through-hole 442 provided at the body 441 so as to accommodate the stabilizer bar 410, and a second through-hole 443 provided at the body 441 so as to accommodate the fixing pin 432 of the fixing member 430.

The first through-hole 442 may include a cut part through which the stabilizer bar 410 can be pushed from the lateral surface of the first through-hole 442 in a manner that the first through-hole 442 can accommodate the stabilizer bar 410 therein.

Referring to FIGS. 14, 18, 19, and 20, the stabilizer unit 400 may include a connection member 450 configured to connect the stabilizer bar 410 to the suspension unit 80. In more detail, the end part 412 of the stabilizer bar 410 may be connected to the suspension bar 81 of the suspension unit 80 through the connection member 450.

The connection member 450 may be formed of a plastic material, and may include a first accommodation portion 460 to accommodate the end part 412 of the stabilizer bar 410 and a second accommodation portion 470 to accommodate the suspension bar 81. The end part 412 of the stabilizer bar 410 may pass through the first accommodation portion 460 of the connection member 450, and the end part 412 of the stabilizer bar 410 may rotate about the center axis of the stabilizer bar 410 in the first accommodation portion 460 of the connection member 450, and may perform the longitudinal translational motion. In addition, the suspension bar 81 may also pass through the second accommodation portion 470 of the connection member 450, and the connection member 450 may rotate about the suspension bar 81 and may perform the translational motion in the longitudinal direction of the suspension bar 81.

A compression portion 413 may be formed at the end of the stabilizer bar 410. As a result, after the stabilizer bar 410 is accommodated in the first accommodation portion 460 of the connection member 450, the compression portion 413 prevents the stabilizer bar 410 from arbitrarily escaping from the connection member 450. The compression portion 413 may be formed by pressurizing the end part of the stabilizer bar 410 in a manner that the compression portion 413 has a longer diameter than the diameter of the stabilizer bar 410.

Referring to FIGS. 18 and 19, the first accommodation portion 460 of the connection member 450 may include a body 461 through which the stabilizer bar 410 passes, and a coupling portion 462 to be coupled to the second accommodation portion 470. The coupling portion 462 may be elongated from the lateral surface of the body 461. In other words, the coupling portion 462 may be elongated from the body 461 in a direction perpendicular to the stabilizer bar 410.

The connection member 450 may include a buffering member 490 configured to suppress vibration and noise caused by contact with the stabilizer bar 410. The buffering member 490 may be formed of a felt material. The buffering member 490 may be arranged to enclose the stabilizer bar 410 in the internal space 468 of the first accommodation portion 460.

An insertion hole having a longer diameter than the diameter of the stabilizer bar 410 may be provided at one end of the body 461 such that the buffering member 490 can be inserted into the insertion hole. A through-hole 466 having a diameter shorter than the diameter of the insertion hole may be provided at the other end of the body 461 so as to prevent separation of the buffering member 490, and the stabilizer bar 410 can pass through the through-hole 466.

A cap 480 for covering the insertion hole to prevent separation of the buffering member 490 may be mounted to the end of the body 461 of the first accommodation portion 460 in which the insertion hole of the buffering member 490 is provided.

The cap 480 may include a through-hole 482 through which the stabilizer bar 410 passes, and a recess 483 configured to store a lubricant to be supplied to the through-hole 482. The recess 483 may be formed to have a longer diameter than the diameter of the through-hole 482 so as to enclose the through-hole 482, and may include a lubricant.

A recess 467 having a longer diameter than the diameter of the through-hole 466 so as to enclose the through-hole 466 may be provided at the other end of the body 461 of the first accommodation portion 460. The recess 467 may store a lubricant to be supplied to the through-hole 466 provided at the other end of the body 461 of the first accommodation portion 460.

The lubricant stored in respective recesses (483, 467) may gradually penetrate respective through-holes (482, 466) according to movement of the stabilizer bar 410 which moves in a direction perpendicular to the respective through-holes (482, 466).

In order to prevent separation of the cap 480 mounted to the first accommodation portion 460, the body 461 of the first accommodation portion 460 may include a catching portion 465, and the cap 480 may include a catching hole 481 capable of being caught in the catching portion 465.

Referring to FIGS. 18 to 20, the second accommodation portion 470 may include a body 471 to accommodate the suspension bar 81, and a coupling protrusion 472 elongated from the body 471 in a manner that the second accommodation portion 470 can be hinged to the first accommodation portion 460.

The coupling portion 462 of the first accommodation portion 460 may include a coupling hole 463 configured to accommodate the coupling protrusion 472 of the second accommodation portion 470. The coupling portion 462 of the first accommodation portion 460 may include a ramp portion 464 configured to guide the coupling protrusion 472 of the second accommodation portion 470 in a manner that the second accommodation portion 470 can be easily snap-coupled to the coupling portion 462 of the first accommodation portion 460.

The coupling protrusion 472 of the second accommodation portion 470 may include a taper portion 476 in a manner that the taper portion 476 can be easily inserted into the ramp portion 464 provided at the coupling portion 462 of the first accommodation portion 460.

Referring to FIG. 20, the body 471 of the second accommodation portion 470 may include a through-hole 473 to accommodate the suspension bar 81 therein, and the through-hole 473 may include a cut part 474 through which the suspension bar 81 can be accommodated through the lateral surface of the through-hole 473.

In addition, at least one recess 475 configured to store a lubricant may be formed at the internal surface of the through-hole 473 in the longitudinal direction of the through-hole 473.

The center part 411 of the stabilizer bar 410 is connected to the tub 11 and both end parts 412 of the stabilizer bar 410 are connected to the suspension bar 81, such that three-dimensional (3D) vibration (i.e., up/down vibration, forward/backward vibration, left/right vibration) of the tub 11 may generate the bending force and the torsional force in the stabilizer bar 410. 3D vibration of the tub 11 can be effectively attenuated by the stabilizer bar 410, the mounting member 420, and the connection member 450 of the above-mentioned stabilizer unit 400.

A connection member according to another embodiment of the present disclosure may further include a temporary fixing device in the second accommodation portion so as to facilitate the coupling process between the first accommodation portion and the second accommodation portion.

Figure 21:
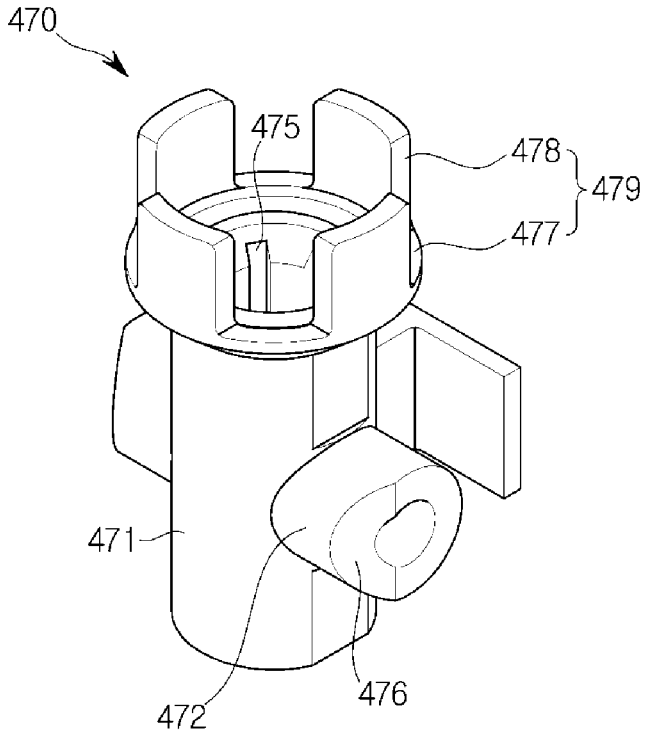
FIG. 21 is a perspective view illustrating a second accommodation portion according to another embodiment of the present disclosure.
Figure 22:
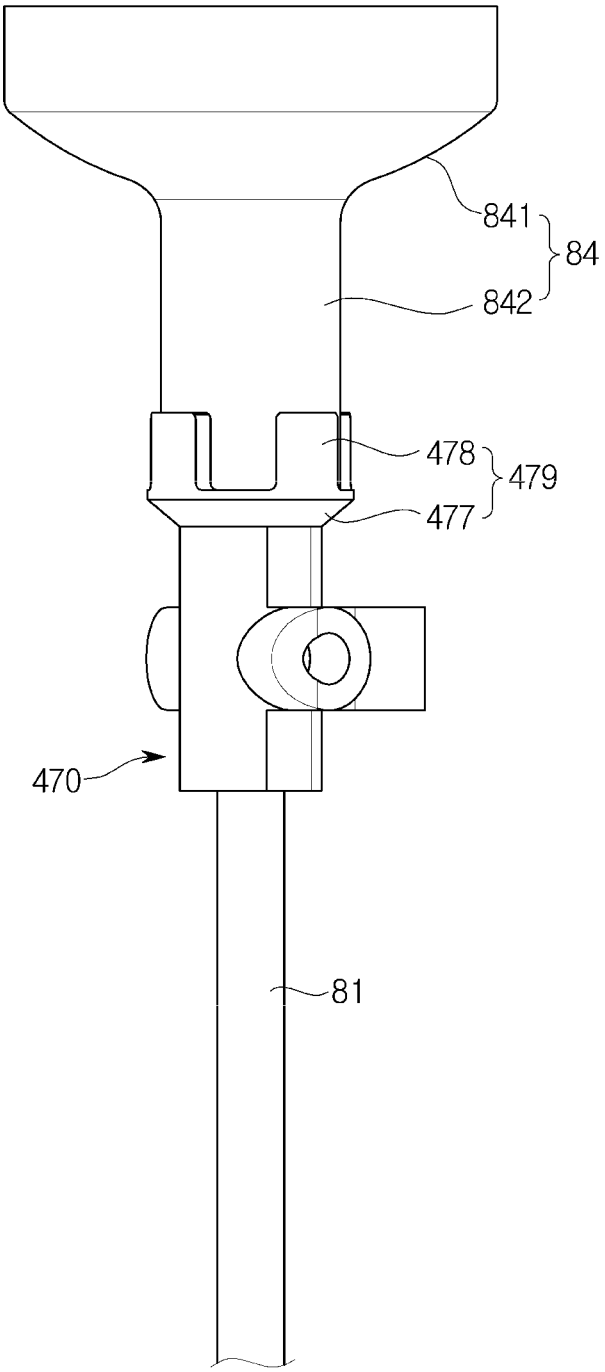
FIG. 22 is a view illustrating that the second accommodation portion of FIG. 21 is temporarily fixed to a suspension cap.

FIG. 21 is a perspective view illustrating a second accommodation portion according to another embodiment of the present disclosure. FIG. 22 is a view illustrating that the second accommodation portion of FIG. 21 is temporarily fixed to a suspension cap.

Referring to FIGS. 21 and 22, the remaining constituent elements of the second accommodation portion 470 other than the temporary fixing device 479 are identical to those of the second accommodation portion 470 shown in FIGS. 14 to 20, and as such a detailed description thereof will herein be omitted for convenience of description.

Referring to FIGS. 1, 2, and 22, the suspension unit 80 may include a suspension cap 84 connected to both ends of the suspension bar 81. The suspension cap 84 may include a head 841 supported by a holder 60 formed at the upper portion of the cabinet 10, and a collar 842 extending from the head 841 to accommodate one end of the suspension bar 81.

Referring to FIGS. 21 and 22, a temporary fixing device 479 is provided in the second accommodation portion 470 of the connection member 450, such that the second accommodation portion 470 can be detachably coupled to the suspension cap 84. In more detail, the temporary fixing device 479 is provided at one end of the body 471 of the second accommodation portion 470, such that it can be coupled to the collar 842 of the suspension cap 84.

The temporary fixing device 479 may include a ring-shaped base 477 connected to one end of the body 471 of the second accommodation portion 470, and a coupling portion 478 extending from the base 477 so as to accommodate the collar therein. The coupling portion 478 may be formed in a serrated shape for elastic deformation such that it can be detachably coupled to the collar 842.

The temporary fixing device 479 may be formed of a plastic material as in the second accommodation portion 470, and may be incorporated with the second accommodation portion 470 in one body.

The second accommodation portion 470 may be temporarily coupled to the suspension cap 84 by the temporary fixing device 479, prior to a coupling process between the second accommodation portion 470 and the first accommodation portion 460. Thereafter, the second accommodation portion 470 is separated from the suspension cap 84 in the above coupling process, and may be coupled to the first accommodation portion 460.

Although not shown in the drawings, both ends of the stabilizer unit according to another embodiment of the present disclosure are not connected to a plurality of suspension units by the connection member, and only one end of the stabilizer unit may be connected to the suspension unit by the connection member.

Referring to FIG. 14, the center part 411 of the stabilizer bar 410 may be cut or severed. In other words, the stabilizer bar is formed in a V shape, such that one end may be connected to the tub by the mounting member and the other end may be connected to the suspension unit by the connection member.

As is apparent from the above description, the washing machine according to embodiments can reduce tub vibration displacement caused by excessive unbalance mass generated during the washing/dehydration processes, and can increase a diameter of the tub within the same frame size, resulting in increased tub capacity.

In addition, the washing machine according to embodiments can reduce vibration displacement of the tub, and can reduce the number of contact times between the tub and the frame and excessive vibration, resulting in reduction of a total washing time of laundry.

Although a few embodiments of the present disclosure have been shown and described, it would be appreciated by those skilled in the art that changes may be made in these embodiments without departing from the principles and spirit of the invention, the scope of which is defined in the claims and their equivalents.

What is claimed is:

1. A washing machine comprising:

a cabinet;

a tub disposed in the cabinet;

a plurality of suspension units configured to attenuate vibration of the tub, and each of the plurality of suspension units are separately spaced around the tub, and interconnect the tub and the cabinet such that the tub is supported by the cabinet, and including a plurality of suspensions bars connected to a first holder formed at the cabinet and a second holder formed at the tub; and a stabilizer unit configured to interconnect the plurality of suspension bars between the first holder and the second holder, and mounted to the tub, wherein the stabilization unit includes at least one stabilizer bar having a V-shape configured to limit a horizontal displacement of the tub and shorten a distance between the tub and the cabinet.

2. The washing machine according to claim 1, wherein:

the at least one stabilizer bar includes a first end connected to a first suspension unit and a second end connected to a second suspension unit among the plurality of suspension units; and the stabilizer unit further includes a mounting member configured to mount the at least one stabilizer bar to the tub.

3. The washing machine according to claim 2, wherein:

the stabilizer unit further includes:

a connection member to connect the at least one stabilizer bar to one of the at least two suspension units, and the at least one stabilizer bar is mounted to a lateral surface of the tub by the mounting member.

4. The washing machine according to claim 2, wherein the stabilizer bar is arranged at a bottom surface of the tub by the mounting member.

5. A washing machine comprising:

a cabinet;

a tub disposed in the cabinet;

a plurality of suspension units configured to attenuate vibration of the tub, and each of the plurality of suspension units are separately spaced around the tub, and interconnect the tub and the cabinet such that the tub is supported by the cabinet, and including a plurality of suspension bars connected to a first holder formed at the cabinet and a second holder formed at the tub; and a stabilizer unit configured to connect the tub to the plurality of suspension bars between the first holder and the second holder, wherein the stabilizer unit includes:

a stabilizer bar configured to enclose some parts of a lateral surface of the tub in a circumferential direction, the stabilizer bar having a V-shape configured to limit a horizontal displacement of the tub and shorten a distance between the tub and the cabinet;

a mounting member configured to mount the stabilizer bar to the lateral surface of the tub; and a connection member configured to connect the stabilizer bar to the plurality of suspension bars.

6. The washing machine according to claim 5, wherein:

a first end and a second end of the stabilizer bar are bent at a predetermined angle so as to receive bending force; and each of the first end and the second end of the stabilizer bar are connected to different suspension units by the connection member so as to receive torsional force.

7. The washing machine according to claim 6, further comprising:

a mounting portion provided at an external surface of the tub such that the mounting member is mounted thereto, wherein the mounting member includes a buffering member accommodated in the mounting portion and a fixing member which fixes the buffering member to the mounting portion.

8. The washing machine according to claim 7, wherein:

the mounting portion includes a first portion extending from a lateral surface of the tub, and a second portion spaced apart from the first portion and extended from a lateral surface; and the fixing member includes a head supported by the first portion of the mounting portion, and at least one fixing pin extending from the head so as to pass through the mounting portion and the buffering member.

9. The washing machine according to claim 8, wherein:

the at least one fixing pin is formed in a cylindrical shape having a hollow; and the at least one fixing pin and the head are elastically deformed.

10. The washing machine according to claim 7, wherein the buffering member includes:

a body formed of an elastic material;

a first through-hole disposed in the body so as to accommodate the stabilizer bar; and at least one second through-hole disposed in the body so as to accommodate the at least one fixing pin.

11. The washing machine according to claim 7, wherein:

each of the plurality of suspension units includes a suspension bar and a suspension cap;

the connection member is configured to connect at least one stabilizer bar to the suspension bar; and the connection member includes a first accommodation portion to accommodate one end of the stabilizer bar and a second accommodation portion to accommodate the suspension bar.

12. The washing machine according to claim 11, wherein the first accommodation portion includes:

a body through which the stabilizer bar passes; and a coupling portion extending from the body so as to be coupled to the second accommodation portion.

13. The washing machine according to claim 12, wherein the connection member includes:

a buffering member disposed in the body of the first accommodation portion so as to enclose the stabilizer bar.

14. The washing machine according to claim 13, wherein:

one end of the body of the first accommodation portion includes an insertion hole in which the buffering member is inserted;

the connection member includes a cap mounted to the one end of the body of the first accommodation portion so as to prevent separation of the buffering member, and the cap includes a through-hole through which the stabilizer bar passes, and a recess to store a lubricant to be supplied to the through-hole.

15. The washing machine according to claim 12, wherein the second accommodation portion includes:

a body to accommodate the suspension bar;

a coupling protrusion through which the second accommodation portion is hinged to the first accommodation portion, wherein the coupling protrusion extends from the body of the second accommodation portion, and the coupling portion of the first accommodation portion includes a coupling hole to accommodate the coupling protrusion.

16. The washing machine according to claim 15, wherein:

the coupling portion of the first accommodation portion includes a ramp portion configured to guide the coupling protrusion in a manner that the second accommodation portion is easily snap-coupled; and the coupling protrusion of the second accommodation portion includes a tapered part through which the coupling protrusion easily enters the ramp portion.

17. The washing machine according to claim 15, wherein:

the body of the second accommodation portion includes a through-hole configured to accommodate the suspension bar, and the through-hole includes a cut part through which the suspension bar is accommodated through a lateral surface of the through-hole.

18. The washing machine according to claim 11, wherein the first accommodation portion includes a temporary fixing portion detachably coupled to the suspension cap.

19. The washing machine according to claim 18, wherein:

the suspension cap includes a head supported by the cabinet, and a collar extending from the head so as to accommodate one end of the suspension bar; and the temporary fixing portion includes a ring-shaped base connected to one end of a body of the second accommodation portion, and a coupling portion extending from the ring-shaped base so as to accommodate the collar, wherein the coupling portion is formed in a serrated shape for facilitation of elastic deformation.

20. A washing machine comprising:

a cabinet;

a tub disposed in the cabinet;

a suspension unit configured to attenuate vibration of the tub, and connect the tub to the cabinet such that the tub is supported by the cabinet, and including a suspension bar connected to a first holder formed at the cabinet and a second holder formed at the tub; and a stabilizer unit configured to connect the suspension bar to the tub between the first holder and the second holder, wherein the stabilizer unit includes:

a V-shaped stabilizer bar connected to the suspension unit and the tub;

a mounting member arranged in a manner that the V-shaped stabilizer bar is mounted to the tub; and a connection member configured to connect the V-shaped stabilizer bar to the suspension unit.

* * * * *